US006793755B2

(12) United States Patent
Schaupp et al.

(10) Patent No.: US 6,793,755 B2
(45) Date of Patent: Sep. 21, 2004

(54) METHOD AND MACHINE FOR PLACEMENT OF MULTIPLE LABELS

(75) Inventors: Richard Schaupp, Modesto, CA (US); Timothy H. Klein, Golden, CO (US); John P. Hickey, Mendota Heights, MN (US)

(73) Assignee: Interactive Packaging Group, Ltd., Golden, CO (US)

( * ) Notice: Subject to any disclaimer, the term of this patent is extended or adjusted under 35 U.S.C. 154(b) by 225 days.

(21) Appl. No.: 10/162,722

(22) Filed: Jun. 3, 2002

(65) Prior Publication Data

US 2002/0185212 A1 Dec. 12, 2002

Related U.S. Application Data

(60) Provisional application No. 60/295,098, filed on Jun. 1, 2001, and provisional application No. 60/309,679, filed on Aug. 2, 2001.

(51) Int. Cl.[7] ..... B65C 3/00

(52) U.S. Cl. ..... 156/215; 156/297; 156/458; 156/468; 156/475; 156/567; 156/DIG. 26; 156/DIG. 27; 198/394

(58) Field of Search ..... 156/200, 201, 156/212, 215, 297, 538, 539, 540, 541, 542, 446, 447, 458, 468, 475, 556, 566, 567, 568, DIG. 8–13, DIG. 18, DIG. 25–27; 198/384–387, 394–395

(56) References Cited

U.S. PATENT DOCUMENTS

| | | | | |
|---|---|---|---|---|
| 2,880,845 A | | 4/1959 | Carter | 198/33 |
| 4,487,650 A | | 12/1984 | Mohn et al. | 156/567 |
| 4,500,386 A | * | 2/1985 | Hoffman | 156/449 |
| 4,714,515 A | * | 12/1987 | Hoffmann | 156/450 |
| 5,058,724 A | | 10/1991 | Hinton | 198/376 |
| 5,326,422 A | * | 7/1994 | Kronseder | 156/566 |
| 5,403,416 A | * | 4/1995 | Bright et al. | 156/86 |
| 5,415,268 A | * | 5/1995 | Lofgren | 198/394 |
| 5,495,944 A | | 3/1996 | Lermer | 206/459.1 |
| 5,605,230 A | | 2/1997 | Marino, Jr. et al. | 206/534 |
| 6,066,223 A | * | 5/2000 | Gomes et al. | 156/215 |
| 6,237,269 B1 | | 5/2001 | Key | 40/638 |

FOREIGN PATENT DOCUMENTS

| | | |
|---|---|---|
| DE | 452 891 C | 11/1927 |
| DE | 31 08 049 A1 | 9/1982 |
| DE | 198 51 733 A | 5/2000 |
| EP | 0 572 758 A | 12/1993 |
| EP | 0 775 643 A1 | 5/1997 |
| FR | 2 538 779 A | 7/1984 |
| WO | WO 98 41966 A | 9/1998 |
| WO | WO 00 48161 A | 8/2000 |

OTHER PUBLICATIONS

International Search Report Nov. 27, 2002 (Ladas & Parry)—PCT/US02/17538.

* cited by examiner

*Primary Examiner*—Jeff H. Aftergut
*Assistant Examiner*—Jessica Rossi
(74) *Attorney, Agent, or Firm*—Cochran Freund & Young, LLC

(57) ABSTRACT

The present invention is a machine to perform two or more processes to an bottle wherein registration of the first process to the second process is required. The products produced with such registration have distinct advantages over prior art. These include labeling systems comprising multiple labels that can be incorporated into many useful variants for promotional items. Additionally, novel packaging systems can utilize this technology.

12 Claims, 35 Drawing Sheets

METHOD AND MACHINE FOR PLACEMENT OF MULTIPLE LABELS

CROSS REFERENCE TO RELATED APPLICATIONS

This application is based upon and claims the benefit of U.S. provisional application No. 60/295,098, entitled "BOTTLE WITH MULTIPLE LABELS", filed Jun. 1, 2001 by Richard Schaupp, Timothy Klein, and John Hickey and U.S. provisional application No. 60/309,679, entitled "MACHINE FOR PLACEMENT OF MULTIPLE LABELS", filed Aug. 2, 2001 by Richard Schaupp, Timothy Klein, and John Hickey, the entire disclosures of both applications are herein specifically incorporated by reference for all that they disclose and teach.

BACKGROUND OF THE INVENTION a. Field of the Invention

The present invention pertains generally to high speed label placement machines and specifically to high speed label placement machines wherein multiple labels are placed on an object.

b. Description of the Background

Labels on beverage bottles and the like are critical sales tools for differentiating one product from another. The ability to stand out from the crowd of beverages can make a large difference in the sales of the product and an increase in market share.

Labels for beverage bottles and the like are applied by different methods. A common method is the roll wrap label wherein a label is presented in the form of a web that is glued at the edges and wrapped around the circumference of the bottle. A second form is a label that is presented on a web carrier and attached with pressure sensitive adhesive. Other forms of labels and methods of application are widely known and practiced.

It is common from time to time for a beverage manufacturer to have a marketing campaign wherein a premium, game piece, coupon, or other promotional item is to be attached to the packaging in some form. Ideally, the promotional item would be included on the beverage bottle directly. However, the manufacturing complexities have so far limited the promotional items to places such as the bottle cap or applied to a carton or other container in which the bottle comes. It is also common for a manufacturer to place RF identifier tags and bar codes to items at the request of a retailer.

One of the difficulties is that the game piece or promotional item is likely to be manufactured in a different manner than the exterior label. For example, it may be a multi-folded item made of card stock and the exterior label may be a plastic film. The promotional item may also be attached to the bottle with pressure sensitive adhesive or other mechanism other than the glue strip of the exterior label.

The difficulty of labeling two dissimilar labels lies primarily in the registration of the two labels with respect to one another. This is due to the fact that one type of label may optimally be manufactured, presented, and applied using one method, such as thin, plastic roll wrapped labels adhered with a strip of glue, and a second type of label may be optimally manufactured, presented, and applied using a second method that is incompatible with the first, such as a cardstock label presented by peeling off of a disposable web backing and applied with pressure sensitive adhesive. In high speed inline labeling machines used in bottling factories, the only option available is a large rotary labeling machine that holds the bottles from the top and bottom during all of the processing done at the machine. These machines are very expensive to buy and operate compared to high-speed in-line machines.

It would therefore be advantageous to provide a high speed in-line machine for applying a first item to a bottle, such as a pressure sensitive label, maintaining control of the orientation of the bottle while adjusting the orientation to a position to receive a second item of the same or different composition, and applying a second item, such as a roll wrapped label. It would further be advantageous to control the registration of the placement of the items to achieve a variety of functions.

c. Definitions

The following definitions are presented for purposes of illustration and description. It is not intended to be exhaustive or to limit the terms to the precise form disclosed, and other modifications and variations may be possible in light of the teachings of this specification.

Bottle: an object that is processed by a high speed in-line or similar machine, such as a beverage bottle. The bottle may be one of several types containers such as plastic bottles, cups, metal cans, glass wine bottles, tubular cardboard containers, aerosol spray cans, pharmaceutical containers, glass jelly jars, plastic jugs, rotationally molded lidded containers for hardware items like screws and such. Further, the bottle may be any object that is typically sold with labels attached, such as highlighter markers, candles, rolls of paper products, and sundry others. The outside shape of the object does not have to be cylindrical, but can be square, elliptical, or can have other cross-sectional shapes.

Label: an item that is applied by a high speed in-line or similar machine to a bottle, such as a pressure sensitive label. The label may be a conventional advertising or descriptive label of various constructions, such as paper, cardstock, plastic film, or other label material. The label may be constructed of a single ply of material, or may be a multiple ply construction. Further, the label may be a booklet construction with multiple pages that are glued or bound on an edge. The conventional label may be applied by many different methods, such as pressure sensitive adhesive, hot glue, cold glue, ultraviolet cure glue, dry peel adhesive, heat transfer, or any other type of adhesive. Further, the label may be applied by static charge or other mechanical method so that it stays on the bottle during assembly until a second label captures and contains the first label. Additionally, the label may be a shrink-wrap label that envelops the bottle and is shrunk to the bottle with a heat source. Alternatively the label may actually be a promotional item such as a premium, game piece, coupon, souvenir, phone card, tickets, or the like. Further, the label may comprise a package for holding a liquid or other items, such as a foil packet. Further, the label may be a passive electrical device, such as an RF identifier tag. Further, the label may be an active electronic device, such as a battery operated light or a device for playing a sound. Alternatively, the promotional item or electrical device may be web converted and presented on a carrier, the carrier being attached directly to the bottle. Further, the label may be a printed mark, logo, set of characters, barcode, or other design that is applied directly by a printing mechanism, such as a sprayed ink printer, transfer printing, pad printing, laser etching, or other printing method. Further, the label may be a brand identifier, logo, or special advertising item. For example, the label may be a holographic image, diffraction grating, reflective media, or other special material. A label may also be a device for tearing or removing a second label. These examples are not meant to limit the types of labels and of course, those skilled in the arts of promotional items, labels, and the general packaging industry would be able to expand these examples and still fall within the scope of this invention.

Game piece: an item specifically adapted for a promotional game. The typical game piece may be of several varieties. These include instant win game pieces where a consumer can redeem the game piece for a prize instantly, may be a collection type game where two or more game pieces must be collected and redeemed together, or other type of game where the consumer compares the game piece code to a code on a website or other advertisement. The game piece typically involves a variable printing process whereby the text or image on the game piece can be varied during the printing process. The game piece may be a simple printed mark on the bottle comprising text, graphics, barcode, or other images. The game piece may be a multipart label where the consumer must peel apart one layer of the label to expose the variable printed image. These examples are not meant to limit the types of game pieces and of course, those skilled in the arts of promotional items, labels, and the general packaging industry would be able to expand these examples and still fall within the scope of this invention.

SUMMARY OF THE INVENTION

The present invention overcomes the disadvantages and limitations of the prior art by providing a high speed in-line machine to assemble labels on a bottle. The machine can be used to apply two dissimilar labels to a bottle wherein each label is applied by a different mechanism. The dissimilar labels may be placed and registered with respect to one another on the bottle. The combinations may be used to create advertising devices and product packaging devices that were heretofore impractical to produce.

One embodiment of the present invention pertains to a high speed in-line bottle labeling machine, wherein bottles travel through the machine in a cradle that allows the bottle to rotate. A first label is presented and applied to the bottle under positive control as it passes through the machine. A positioning mechanism rotates the bottle a controlled amount in the cradle to a second orientation. A second label is presented and applied to the bottle as it continues through the machine and then exits the machine. The registration of the two labels is controlled with the repositioning devices.

The first label to be applied can be of any desired construction and attached to the bottle by any desired method. For example, the label may comprise a preprinted, adhesive backed label, an RF identifier tag on a pressure sensitive backing, a promotional game piece applied with glue, a package of liquid additive for the contents of the bottle applied with hot glue, or a barcode image printed directly on the bottle, etc. Of course, this list is merely an example of the diverse set of articles that may be placed, printed, adhered, applied or otherwise assembled to the surface of the bottle.

The cradle mechanism is constructed to support the bottle and allow the bottle to rotate while it is presented to the first label station, the positioning device, and the second label station.

The positioning mechanism can be a single powered roller, a continuously moving, constant speed belt, a belt that can be adjusted in speed and direction during the turning process, a stationary frictional surface, or other mechanism or combination of mechanisms to change the orientation of the bottle while it is in the cradle. Further, the positioning mechanism may be incorporated into a processing station, such as a label applicator, or the positioning mechanism may be a separate entity that is not attached to one or more processing stations.

The second label to be applied can be of any desired construction and attached to the bottle by various methods. For example, the second label may be a roll wrapped plastic film label or other type of label. Of course, the example is meant only for illustrative purposes.

The invention also includes the advertising and packaging devices heretofore unproducible on conventional packaging equipment. Several variations of multiple labels that are used in accordance with the present invention require registration of the labels with respect to each other that is the result of positive control of the bottle during labeling.

For example, a first label, such as a promotional game piece, may be placed on a bottle and have a second label placed over the first. The second label must be registered to the first so that the glue used to assemble the second label to the bottle does not overlap the first label. In this embodiment, the consumer can remove the second label to gain access to the first in order to play the game.

In a second example, a first label such as a game piece, may be placed onto a bottle and a second label may be placed over the first label with a window through the second label so that the first label is visible. The second label must be registered to the first label so that the window is properly located and the first label is therefore visible.

A third example may be the placement of a first label, such as a game piece on a bottle. A second label having a window may then be placed over the first label, such that the first label is visible through the window. One or more edges of the first label may be viewable through the window. In this example, perforations may be added to the first or second labels to assist the consumer in removing the promotional item. Further, an exposed edge of the first label may not have adhesive applied near the edge so that the consumer may use a fingernail to further assist in removing of the first label. The second label must be registered to the first label so that the window shows the appropriate section of the first label.

A fourth example may be a bottle that may be labeled first with a booklet attached with pressure sensitive adhesive and covers a portion of the circumference. A second label may be a roll wrapped plastic film label and attached to or near one end of the first label and continue around the remainder of the circumference to end on or near the opposite end of the first label. Registration of the second label to the first is important so that the overlap of the two labels does not interfere with the use and function of the booklet.

A fifth example is a bottle wherein an adhesive backed RF tag may be placed on a bottle and a second label is roll wrapped around the complete exterior of the bottle, covering the RF tag so that it is not unsightly. Instead of an RF tag, a promotional item, such as a ticket or coupon may be placed underneath the second label. The registration of the RF tag to the roll wrapped label is important since the RF tag may interfere with the gluing of a roll wrapped label if improperly registered.

A sixth example is a bottle with a roll wrapped label applied with glue with the label covering the circumference of the bottle and a second label which is a promotional item adhered with pressure sensitive adhesive to a specific location to the outside of the first label. In this case, the second label may be a decorative item manufactured of a different method than the first, such as a holographic image or diffraction grating. The second label should be registered to the first so that the promotional item occupies a designated space on the first label.

A seventh example is a bottle with a first label, such as a removable game piece, viewable through a window in the second label. In this case, the first label has two edges that are exposed through the window and perforations or scoring along the edges that are not exposed. This combination allows the consumer to remove the first label without damaging the second label. The second label must be registered to the first label so that the perforated lines are positioned properly to aid the consumer in removing the game piece.

An eighth example is a bottle with a first label and a second label that is moveable over the first. The second label may be a roll wrapped label wherein the label is glued only to itself and not the bottle, so that the second label may be twisted on the bottle. One or more windows in the second label can then be moved over the first label, creating a game for the consumer to play. The second label must be registered with respect to the first label to avoid any assembly problems with the roll wrapped label assembly.

A ninth example is a bottle with a first label that is entrapped on three sides by a second label. The second label has a window or cut out whereby three edges of the first label are covered and the forth edge of the first label is exposed. Registration between the first label and second label must be sufficient so that the first label does not interfere with the assembly process of the second label.

A tenth example is a bottle with an outside label and a tab label, string, or other device that aids in the removal of the label. The outside label may have perforations, scoring or other devices to aid in the tearing of the label. The device to aid removal may have a tab that is exposed for the consumer to grip as the consumer removes the outer label. The outside label must be registered to the tab label for the tearing action of the tab label to be effective.

An eleventh example is a bottle with a first label that is opaque and a second label that is printed on a transparent media. The first label may be a standard product label and the second label may be a special promotional label. The second label is selectively transparent so that portions of the first label are visible through the second. The second label must be registered to the first label so that the proper visual effect of the two labels is achieved.

A twelfth example is a bottle with a first item that is applied and an overlapping label with a window through which protrudes a portion of the first item. The first item may be a container for something or it may be decorative item only. The container may be used for promotional items such as a premium, or it may be used for a complementary product or accessory to the item sold in the container, such as a package of mounting screws for a container of a hardware product. The overlapping label, and its window must be registered with respect to the first item so that the first item fits through the window properly, otherwise the overlapping label will not assemble correctly.

The above examples are not exhaustive of the combinations of items to be placed on a bottle where the registration of the items is important. As one skilled in the art would appreciate, the present invention would apply to bottles, cans, and other containers or objects especially cylindrical containers and objects to which labels and other articles are applied.

The present invention may therefore comprise a method of applying at least two labels to a substantially cylindrical object with a predetermined angular orientation of the labels about the axis of the cylinder on an in-line labeling machine comprising: placing the object into a cradle, the cradle allowing the object to freely rotate about the axis, the cradle being mounted to a star wheel comprising a plurality of the cradles; passing the object past a first labeling machine, the first labeling machine being capable of presenting a first label and applying the first label to the object by rotating the object in the cradle; positioning the object with a turning mechanism, the turning mechanism having a mechanism that engages the object on the cylindrical surface and changes the rotational orientation of the object to a predetermined orientation; and presenting the object to a second labeling machine, the second labeling machine being capable of presenting a second label and applying the second label to the object, the second label being in a predetermined angular orientation with respect to the first label.

The present invention may further comprise an in-line machine for applying at least two labels to a substantially cylindrical object with a predetermined angular orientation of the labels about the axis of the cylinder comprising: a star wheel, the star wheel comprising a plurality of cradles, the cradles allowing the object to freely rotate about the axis; a first labeling machine, the labeling machine being capable of presenting a first label and applying the first label to the object by rotating the object in the cradle; a turning mechanism, the turning mechanism having a mechanism that engages the object and changes the rotational orientation of the object to a predetermined orientation; and a second labeling machine, the labeling machine being capable of presenting a second label and applying the second label to the object, the second label being in a predetermined angular orientation with respect to the first label.

The present invention may further comprise an object with multiple labels comprising: an object being substantially cylindrical and having a major axis; a first label; and a second label, the second label being placed over at least a portion of the first label, the position of the second label being angularly oriented about the major axis of the object with respect to the first label, wherein the first label and the second label are adhered to the object by different mechanisms.

The present invention may further comprise a substantially cylindrical object with at least two labels manufactured on an in-line labeling machine using a process comprising: placing the object into a cradle, the cradle allowing the object to freely rotate about the axis, the cradle being mounted to a star wheel comprising a plurality of the cradles; passing the object past a first labeling machine, the first labeling machine being capable of presenting a first label and applying the first label to the object by rotating the object in the cradle; positioning the object with a turning mechanism, the turning mechanism having a mechanism that engages the object on the cylindrical surface and changes the rotational orientation of the object to a predetermined orientation; and presenting the object to a second labeling machine, the second labeling machine being capable of presenting a second label and applying the second label to the object, the second label being in a predetermined angular orientation with respect to the first label.

The advantages of the present invention are that a plethora of options for the label designer and marketing professional to create product differentiation for their specific application. Further, the ability to accurately place multiple labels of different constructions allows the marketing professional many options for displaying product information, for hiding unsightly RF tags, for developing promotions, and for other options within their purvey. Also, since the labels can be applied at high speed, the manufacturing of these products can be done in a cost efficient manner.

DETAILED DESCRIPTION OF THE INVENTION

Figure 1:
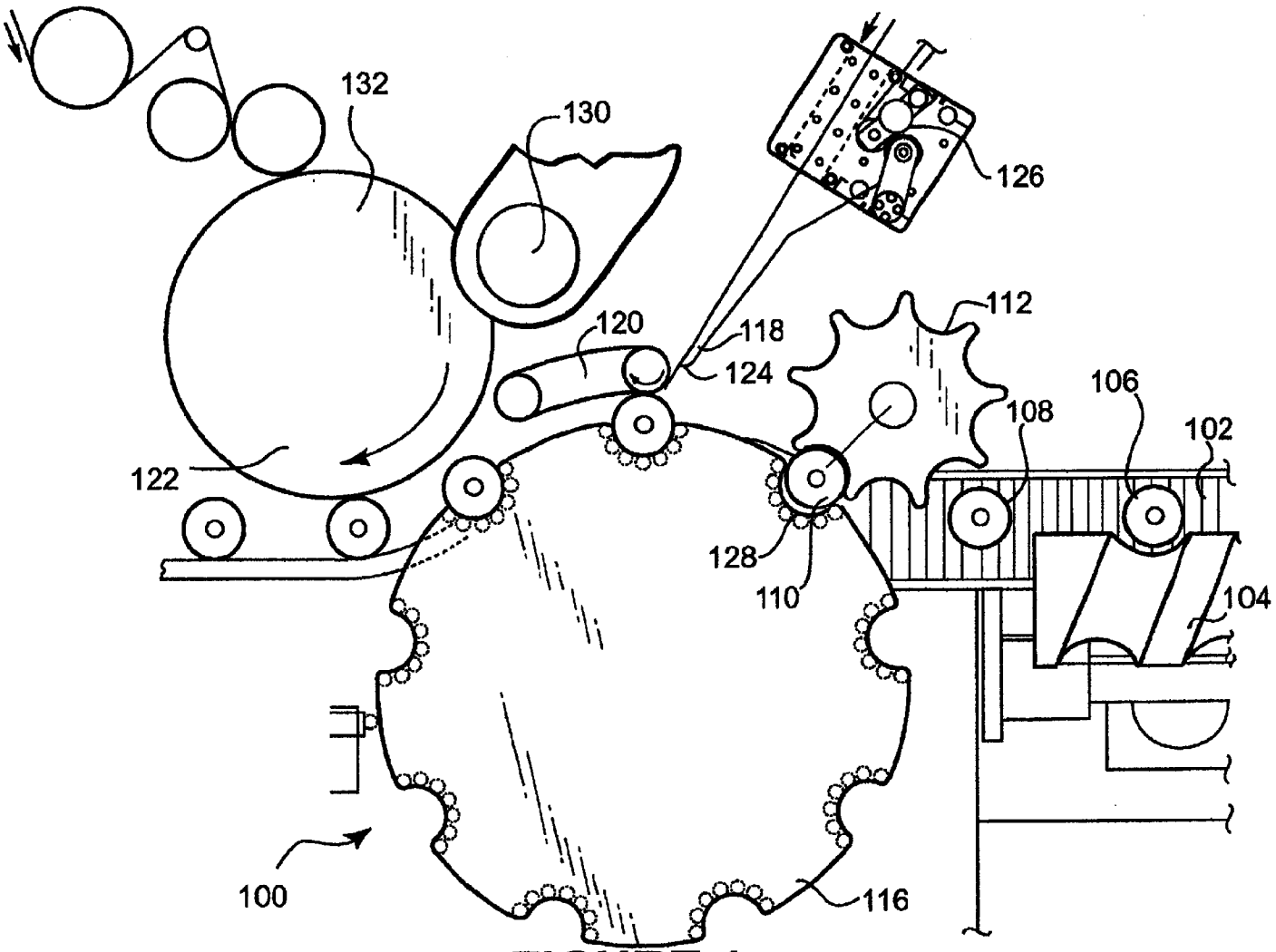
FIG. 1 is a top view of a high speed bottle labeling machine showing a first label being attached with pressure sensitive adhesive and a second label being a roll wrapped label applied with hot glue and a positioning mechanism comprising a moving belt.

FIG. 1 illustrates an overall view of an embodiment of the inventive machine wherein the positioning device is a moving belt. The bottles move from right to left through the machine. The bottles enter the machine on conveyor 102 and inlet screw 104 separates bottles to be fed into the machine 100. Bottle 106 is shown in the inlet screw 104, and bottle 108 is shown traveling on the conveyor 102 properly separated from bottle 110. The inlet star wheel 112 takes each bottle in turn and nestles it into cradle 128 in the main star wheel 116. Bottle 110 is shown just prior to being nestled into cradle 128. The main star wheel 116 is rotated in a counter clockwise direction, moving the bottles past first label station 118, a positioning device 120, and a second label station 122.

The first label station 118 is a conventional label dispenser for a pressure sensitive adhesive backed label. These types of label applicators transport the labels on a web that is passed over a peel point 124 wherein the web is forced to turn on a very small radius, causing the labels to peel from the web. The web is advanced by a pinch roller mechanism 126 when one label is removed and another one required.

The positioning device 120 is a powered belt that causes a bottle in a cradle to rotate as it passes past the positioning device 120. In this embodiment, the positioning device 120 is incorporated in first label station 118.

The second label station 122 is a conventional roll wrapped label applicator. These types of label applicators have the labels presented in the form of a web, which is cut and placed on a vacuum drum 132. A strip of glue is then applied to each end of the labels by the glue dispensing mechanism 130. The leading edge of the label is applied to the bottle, and the bottle is rolled against a friction pad until the glued trailing edge of the label is adhered to the bottle.

Those skilled in the art can readily appreciate the various combinations of a first processing station, a registration mechanism, and a second processing station of which the machine 100 is a single embodiment. Alternative embodiments may include any combination of two different or the same label applicators, such as a roll wrapped applicators, applicators for web converted products such as the nip roller style or tamp and blow style, pick and place style applicators, applicators for liner-less labels, burst and place applicators for items separated by perforations or scoring, static charged applicators for adhesive-less application of labels, applicators for labels with ultraviolet cured adhesive, and any other label applicator. Additional embodiments may have one or both processing stations comprise a printing or etching station, such as a laser etching station for etching an image, barcode, or text onto a plastic bottle, a pad printing station, a heat transfer printing machine, an ink jet type printing device, or other direct printing type of station. Further, another embodiment may be the first processing station comprising a glue dispensing station and the second processing station comprising a label applicator that places the label onto the glue.

Although the number of objects attached to a bottle in the embodiment of FIG. 1 is shown as two objects, any number of objects (within reason) can be placed on the bottle. The example of two labels is given only for exemplary purposes and it can be fully appreciated by persons skilled in the art that the same principles and concepts of the invention do encompass designs wherein the number of processing stations can be greater than two.

Figure 2:
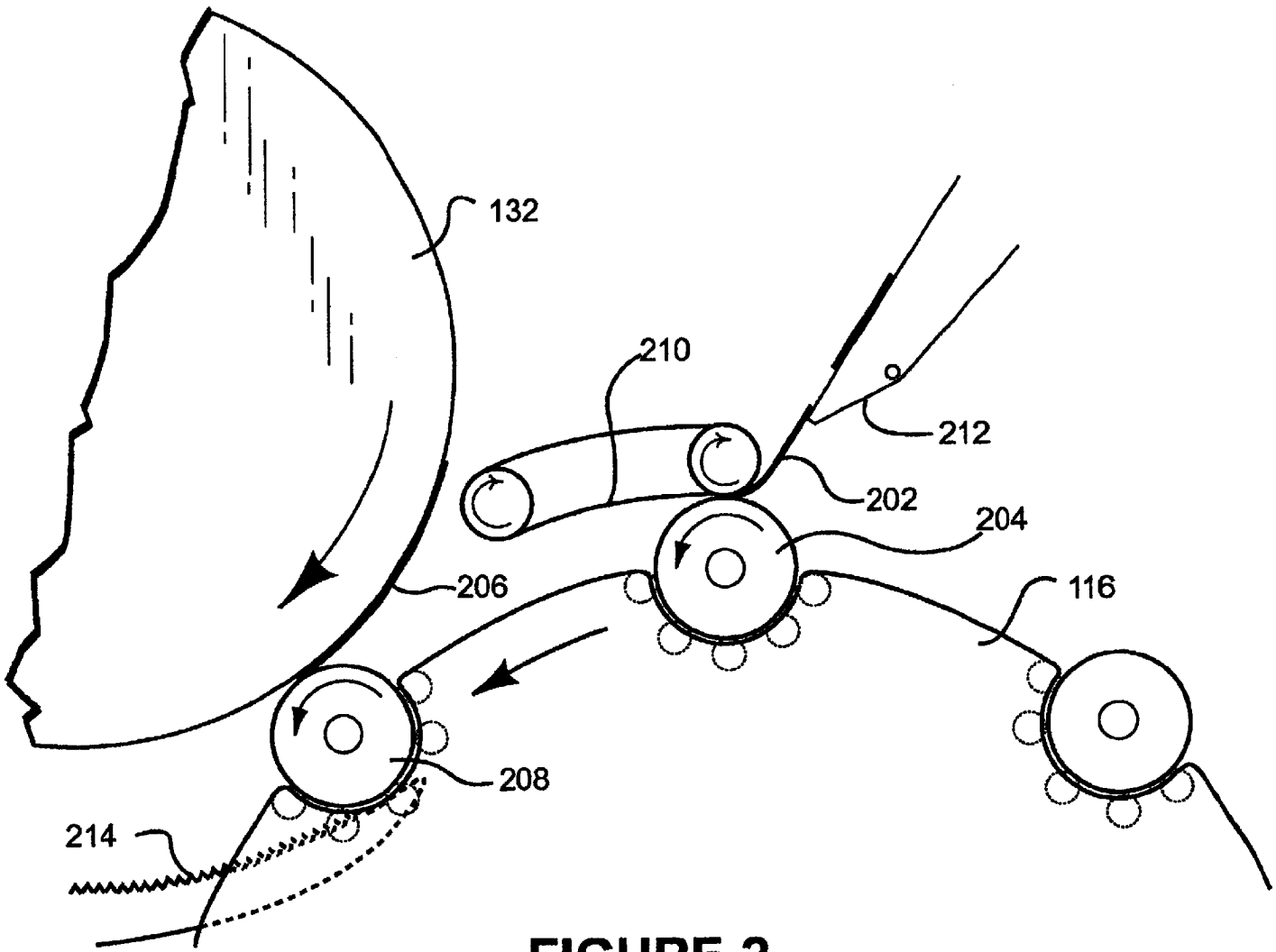
FIG. 2 is a detail view of a section of FIG. 2 showing the first label being applied.

FIG. 2 illustrates a detail view of the embodiment of FIG. 1, showing the application of a first label 202 to bottle 204 and a second label 206 to bottle 208. As the bottle 204 advances towards the belt 210, first label 202 is pinched between the bottle 204 and the belt 210. At this point, known as the nip point, the belt's clockwise rotation pulls the remainder of the first label 202 off of the web 212 and presses the first label 202 onto the bottle 204. As bottle 208 advances toward vacuum drum 132, second label 206 is applied to bottle 208. The rotation of vacuum drum 132 in a clockwise direction forces bottle 208 against a frictional fence 214, which rolls the label 206 onto the bottle 208. It is not necessary for the proper function of the machine that the two labels be applied simultaneously.

Figure 3:
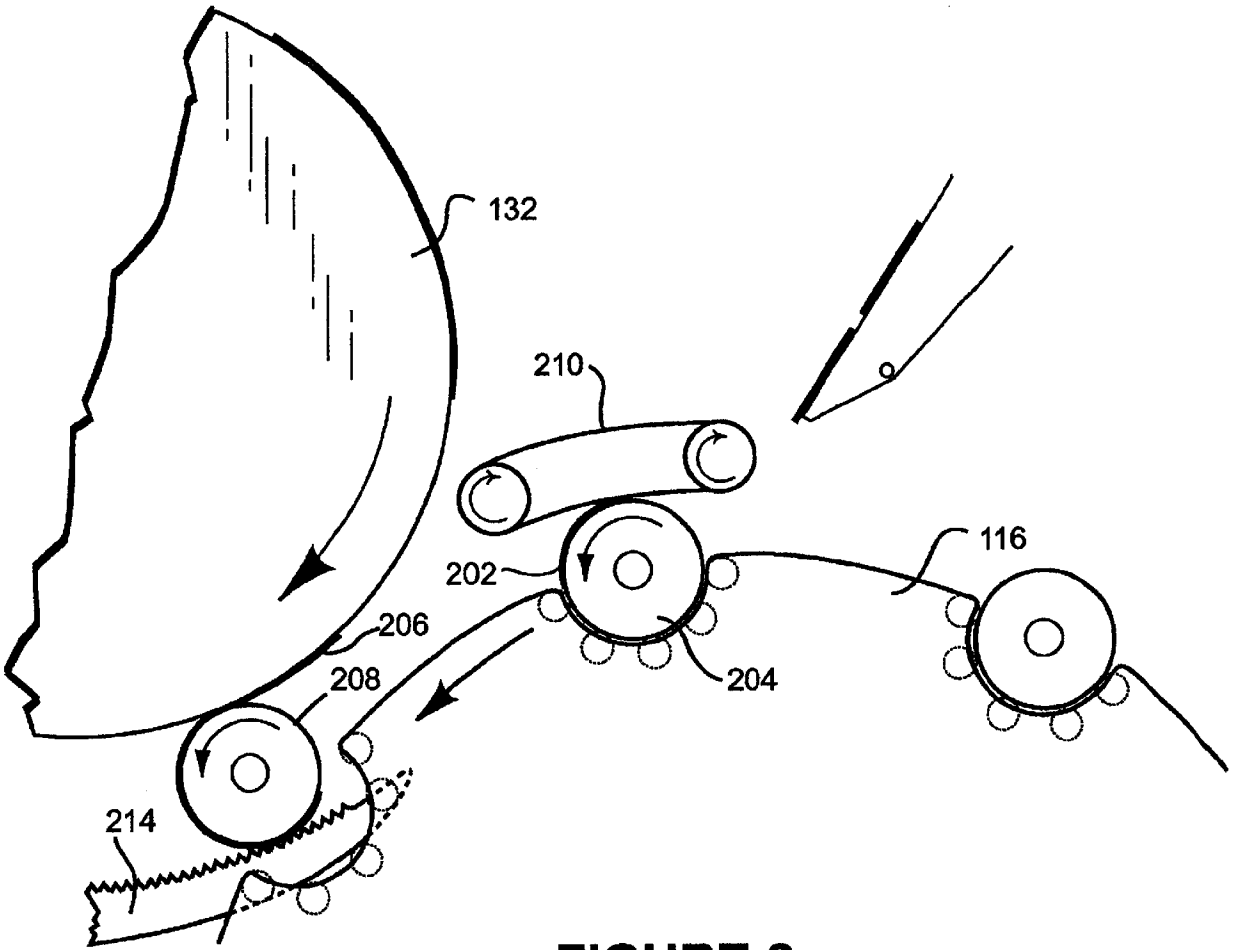
FIG. 3 is view similar to FIG. 2, but showing the bottle at the point where the first label has just been applied, and a second bottle ready for the second label application.

FIG. 3 illustrates a detail view of the embodiment of FIG. 1, and similar to FIG. 2 except that the main star wheel 116 has advanced to the point where the bottle 204 is being positioned by the belt 210. At this point, the belt 210 is spinning the bottle 204 in a counter clockwise direction. Bottle 208 is also being spun in a counter clockwise direction by virtue of the clockwise rotation of vacuum drum 132 pressing bottle 208 against frictional fence 214. Second label 206 is almost fully attached to the bottle 208.

The construction of belt 210 may be a timing belt with teeth, or may comprise an o-ring or other belting medium. The belt 210 is such that it frictionally grabs the bottle 204 and causes it to spin. The belt 210 may further comprise an upper and lower belt such that the upper and lower belts touch the bottle in certain areas and avoid touching the bottle in other areas. Such a configuration may be required if, for example, the first processing station applied an area of glue and it was desired that the belt 210 not touch the glue during positioning.

The gear ratio of the belt 210 to the main star wheel 116 is selected so that the first label 202 is fully applied to the bottle 204 and positions the bottle 204 in the cradle to accept the second label. The gear ratio of belt 210 to main star wheel 116 may be further increased or decreased to adjust the position of the bottle 204 in the cradle. In this manner, the registration of the first label 202 to the second label is adjusted during machine set up and operation. As the speed of the machine increases, the effects of inertia when the bottle is spinning, friction in the cradles, and other elements combine to shift the registration of the first and second labels. By adjusting the gear ratio between the belt 210 and the main star wheel 116 as the speed increases, an operator or set up technician can adjust the registration of the two labels. It is common for the belt 210 to be controlled with a servo motor which is electronically geared to an input, such as an encoder on the main star wheel 116. Being electronically geared the effective gear ratio to change with different parameters, including speed of the main star wheel 116.

An alternative method to a constant gear ratio belt 210 is to change the speed of the belt 210 during the period that it is engaged with the bottle 204. For example, the belt 210 may begin so that the surface speed of the belt 210 is the same as the surface speed of the bottle 204 as it touches the nip point. After the label 202 is nipped between the belt 210 and the bottle 204, the belt 210 may be increased in speed to apply the label and position the bottle 204, and then it may be slowed down to the same speed as at the nip point. This speed profile leaves the bottle 204 in a state where it is not rotating in the cradle, which tends to minimize the inaccuracy of the registration of the first label to the second.

Further, an alternative embodiment of the positioning mechanism 210 may comprise a series of belts that rotate the bottle at different speeds or speed profiles during the passage of the bottle through the machine. For example, a first belt may apply a first label at a certain preset speed that is geared to the speed of the main star wheel 116. A second belt may have a variable speed profile that positions the bottle in the cradle.

A feedback system may be employed in the positioning mechanism to sense the label position and dynamically adjust the exact position of the bottle in the cradle to accept a second label. The feedback system may be attached to any of the embodiments of the positioning mechanism.

Figure 4:
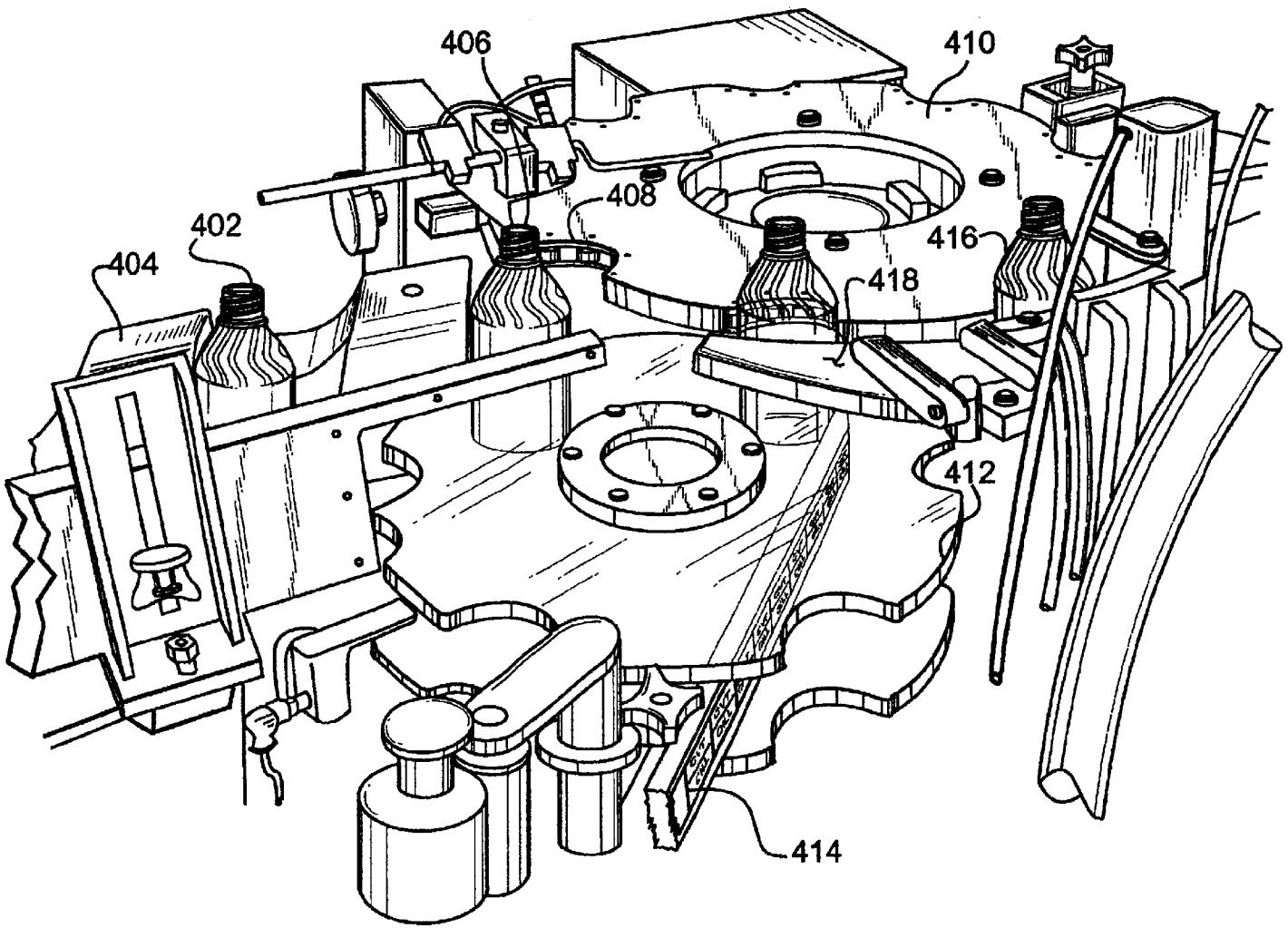
FIG. 4 is a perspective view of the embodiment of FIG. 1.

FIG. 4 shows a perspective view of the embodiment shown in FIG. 1. In this view, the bottles move from left to right through the machine. A bottle 402 is shown being separated by inlet screw 404. A second bottle 406 is shown just prior to being placed in cradle 408 in main star wheel 410 by inlet star wheel 412. Main star wheel 410 turns in a counter clockwise direction in this view. A portion of the first label feeder mechanism 414 is visible. The bottle 416 is in the positioning station where the first label is fed and the bottle repositioned for the second label. The bottle 416 is guided at the top by guide rail 418.

Figure 5:
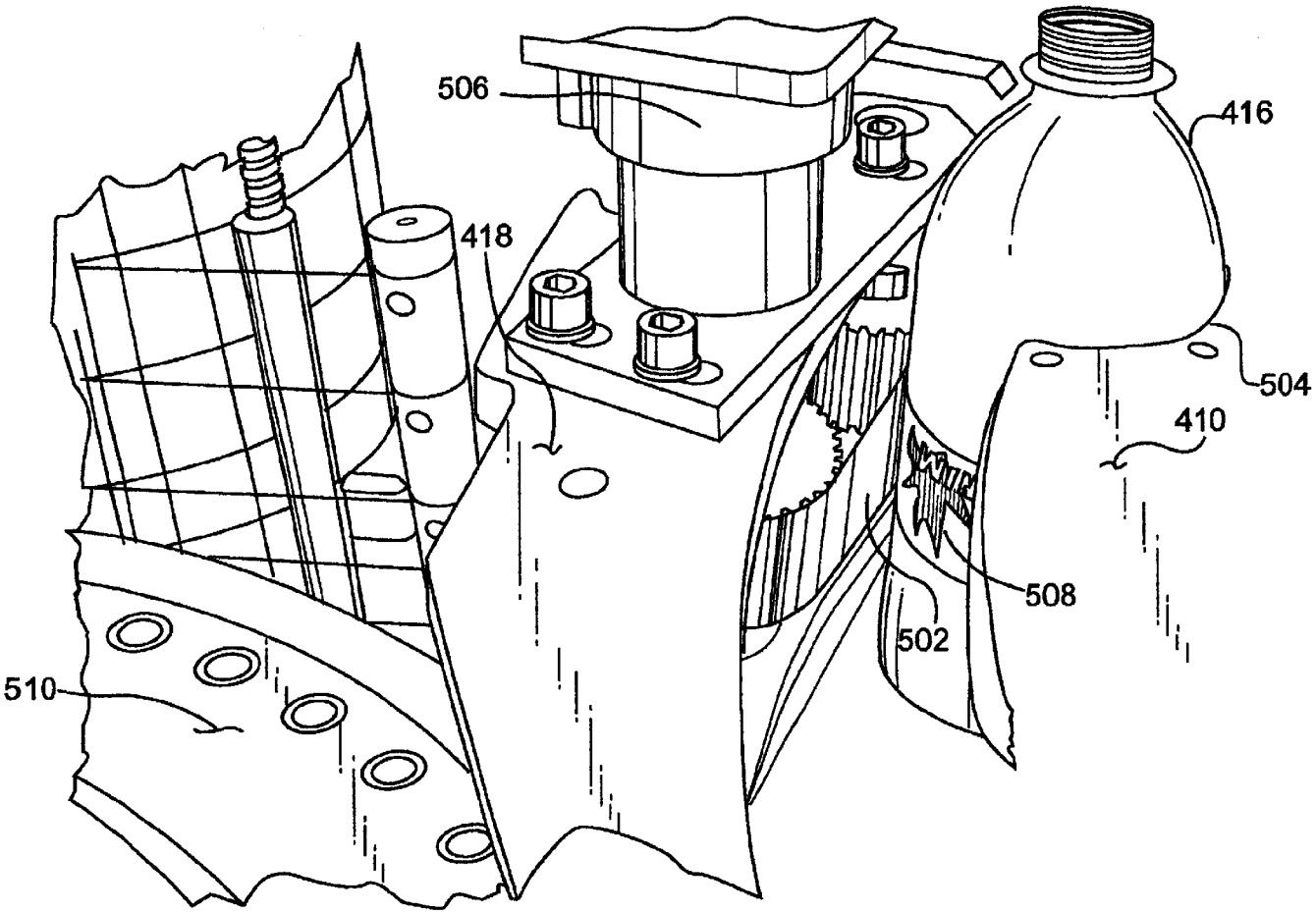
FIG. 5 is a perspective view of a detail of the embodiment of FIG. 4, shown from the opposite side of the machine from FIG. 4.

FIG. 5 shows a detail perspective view of the machine of FIG. 4, showing the positioning belt 502 from the opposite side of the machine as the view of FIG. 4. In this view, the main star wheel 410 moves in a counter clockwise direction and the bottles progress from right to left. Bottle 416 is shown in cradle 504 being turned by belt 502. Belt 502 is driven by servo motor 506 shown partially cut away. The servo motor 506 is being driven in a counter clockwise direction. First label 508 is shown attached to the bottle 416 as the bottle 416 is being rotated to a specific position prior to receiving a second label. Vacuum drum 510 turns in a clockwise direction and places the second label on the bottle.

Figure 6:
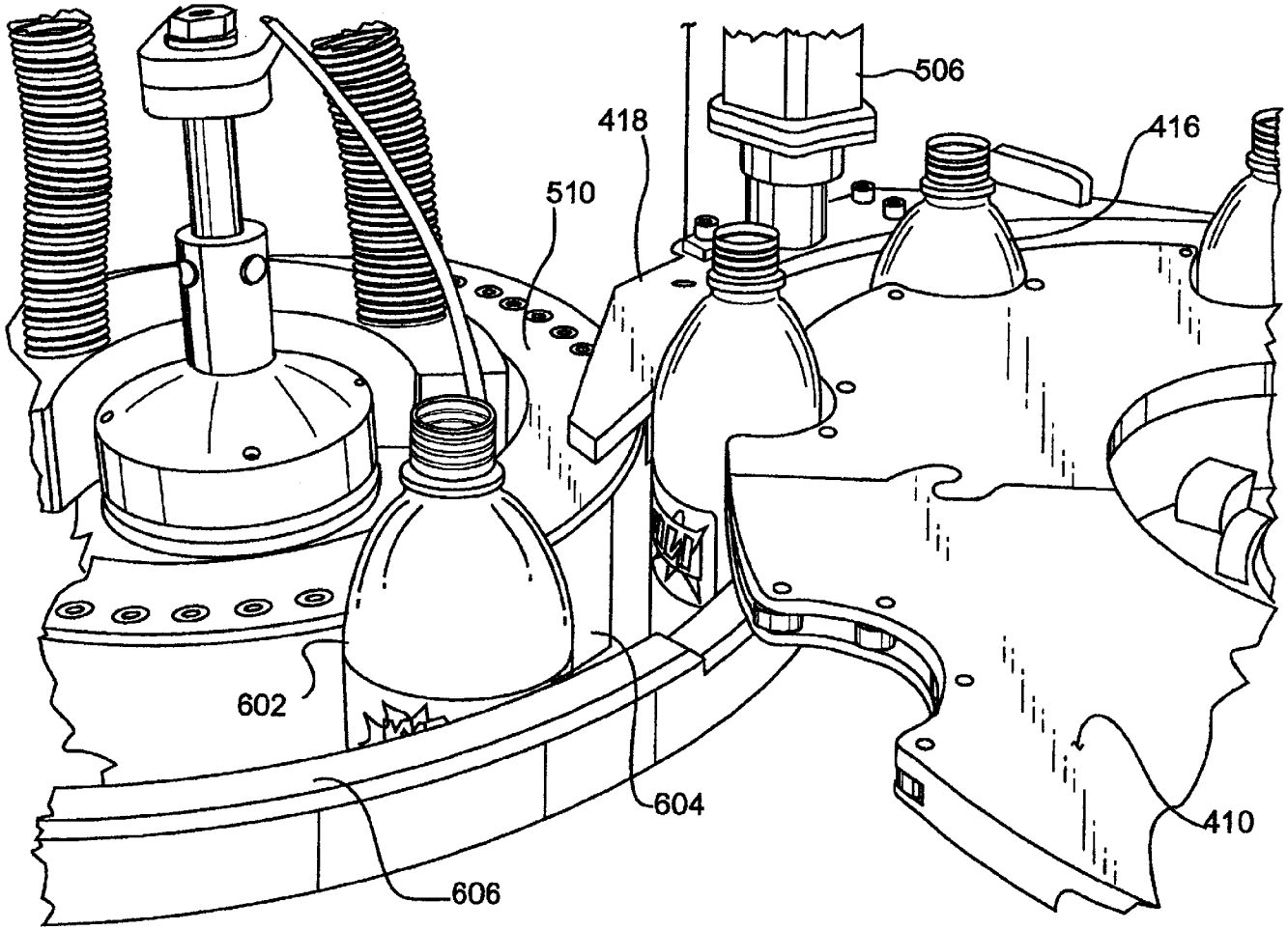
FIG. 6 is a perspective view of a detail of the embodiment of FIG. 5.

FIG. 6 shows a wider detail perspective view of the machine of FIGS. 4 and 5, taken from the same side of the machine as FIG. 5. In this view, the bottles progress from right to left and main star wheel 410 moves in a counter clockwise direction. Bottle 416 is shown in main star wheel 410 along with motor 506 and guide 418. Bottle 602 is in the process of receiving second label 604 from vacuum drum 510. As the bottles begin the process of receiving the second label, they are forced to roll against friction surface 606 that simultaneously removes the bottles from their cradles in main star wheel 410.

Figure 7:
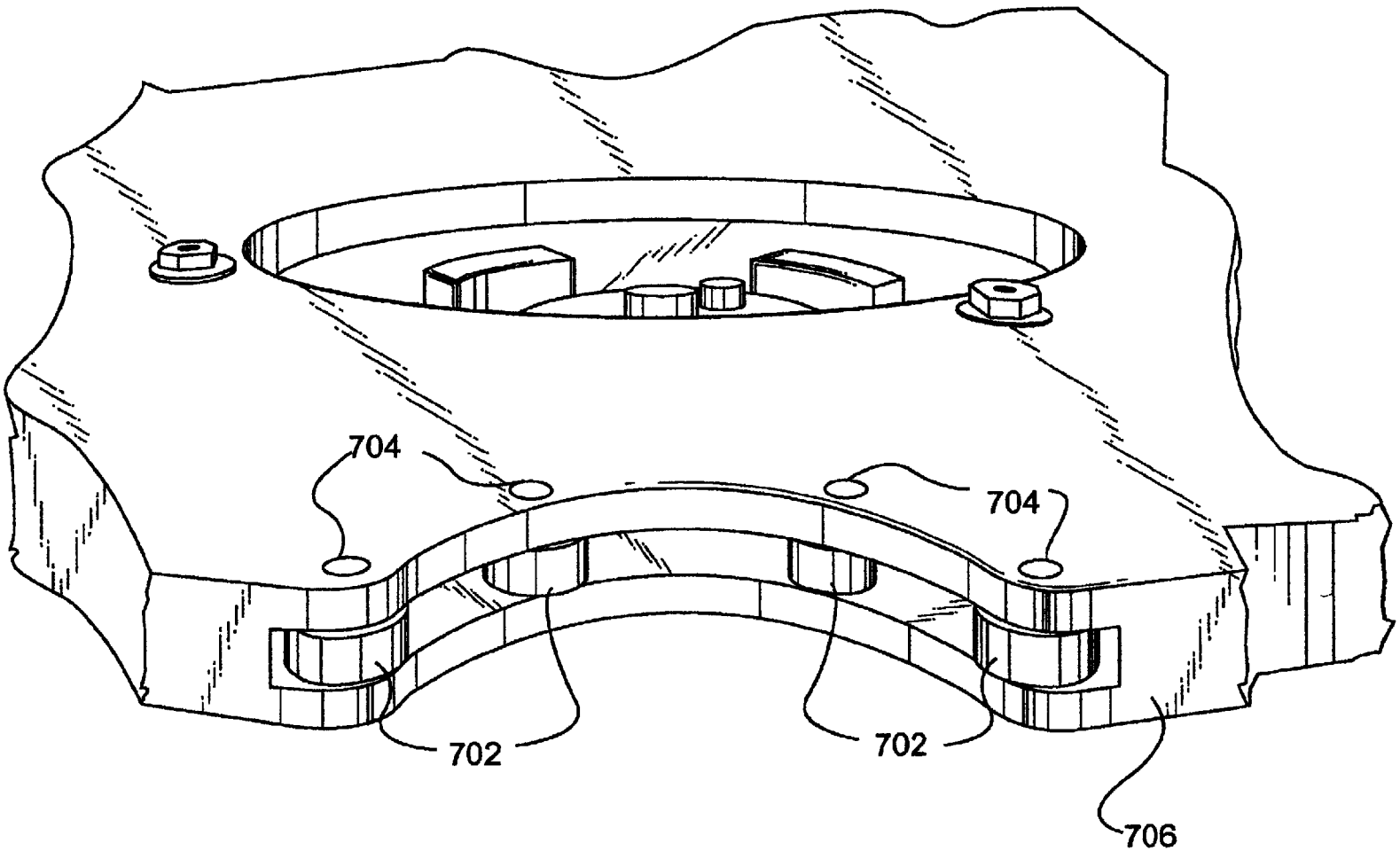
FIG. 7 is a perspective view of the cradle of the embodiment of FIG. 4.

FIG. 7 shows a close up view of a typical cradle in a main star wheel of a typical embodiment of the invention. The cradle comprises several wheels 702 in a semicircular shape. The bottles rest against the wheels 702 without being marred or damaged. The wheels 702 are mounted on axles 704 which are pressed through plate 706. The wheels 702 are further mounted on bearings that are not seen in this view.

Figure 8:
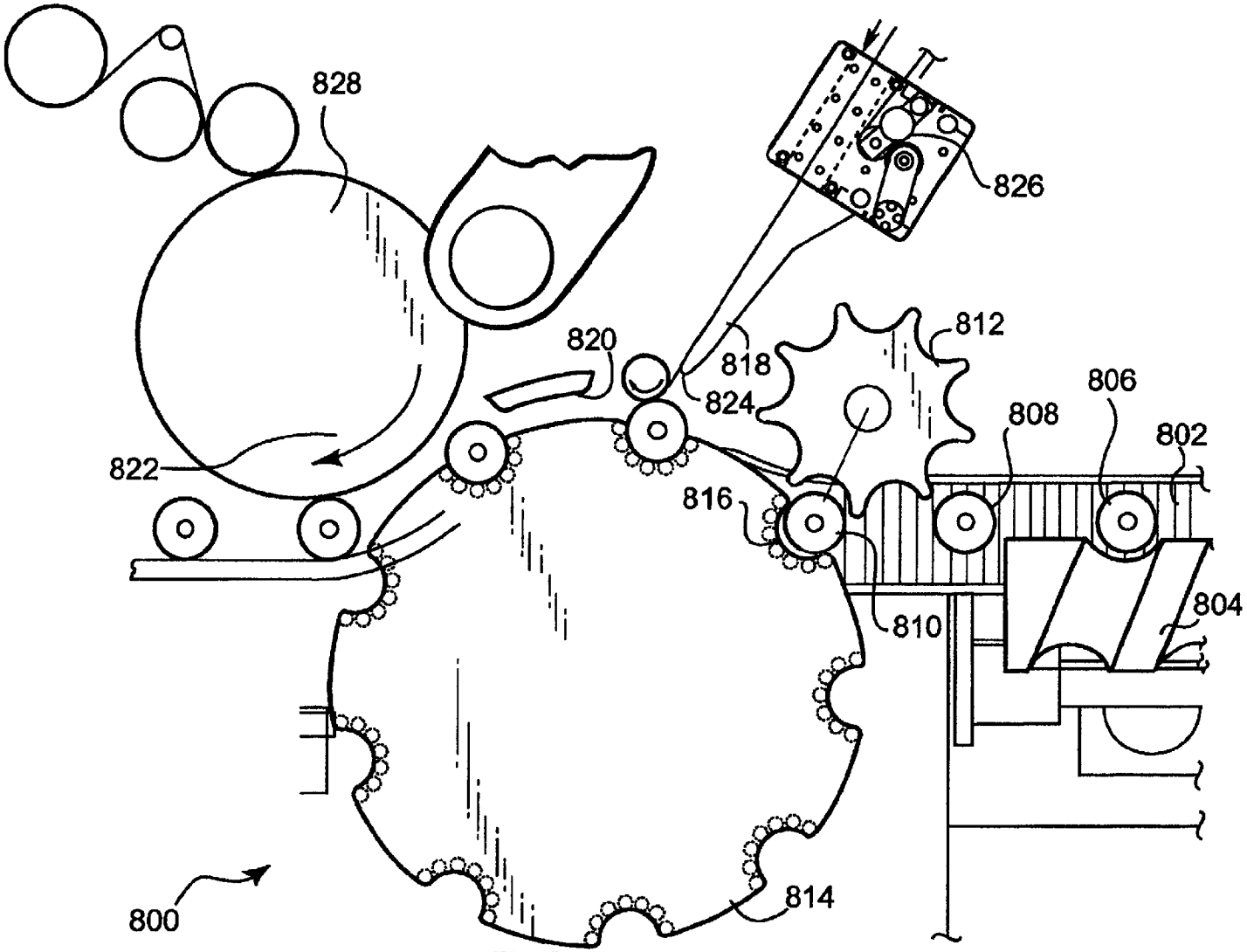
FIG. 8 is a top view of a high speed bottle labeling machine showing a first label being attached with pressure sensitive adhesive and a second label being a roll wrapped label applied with hot glue and a position mechanism comprising an applicator wheel and a friction fence.

FIG. 8 shows a top view of another embodiment of a high speed bottle labeling machine 800. The bottles progress through the machine from right to left in this view. The bottles enter the machine on conveyor 802 as inlet screw 804 separates bottles to be fed into the machine 800. Bottle 806 is shown in the inlet screw 804, and bottle 808 is shown traveling on the conveyor 802 properly separated from bottle 810. The inlet star wheel 812 takes each bottle in turn and nestles it into a cradle in the main star wheel 814. Bottle 810 is shown just prior to being nestled into cradle 816. Bottle 830 is shown in contact with nip roller 832.

The main star wheel 814 is rotated in a counter clockwise direction, moving the bottles past first label station 818, an optional fixed positioning device 820, and a second label station 822.

The first label station 818 is a conventional label dispenser for a pressure sensitive adhesive backed label. These types of label applicators transport the labels on a web that is passed over a peel point 824 wherein the web is forced to turn on a very small radius, causing the labels to peel from the web. The web is advanced by a pinch roller mechanism 826 when one label is removed and another one required.

The optional fixed positioning device 820 may be a frictional pad that causes a bottle in a cradle to rotate as the bottle passes over the device 820. The purpose of the positioning device is to turn the bottle a certain amount between the first label station 818 and the second label station 822. In this manner, the registration of a label applied by the first label station 818 is maintained with a second label applied by second label station 822.

The second label station 822 is a conventional roll wrapped label applicator. These types of label applicators have the labels presented in the form of a web, which is cut and placed on a vacuum drum 828. A strip of glue is then applied to each end of the labels. The leading edge of the label is applied to the bottle, and the bottle is rolled against a friction pad until the glued trailing edge of the label is adhered to the bottle. The second label station 822 may comprise any type of processing equipment that requires that the bottle be registered between the first and second processing station.

Those skilled in the art can readily appreciate the various combinations of a first processing station, a registration mechanism, and a second processing station of which the machine 800 is a single embodiment. Alternative embodiments may include any combination of two different or the same label applicators, such as a roll wrapped applicators, applicators for web converted products such as the nip roller style or tamp and blow style, pick and place style applicators, applicators for liner-less labels, burst and place applicators for items separated by perforations or scoring, static charged applicators for adhesive-less application of labels, applicators for labels with ultraviolet cured adhesive, and any other label applicator. Additional embodiments may have one or both processing stations comprise a printing or etching station, such as a laser etching station for etching an image, barcode, or text onto a plastic bottle, a pad printing station, a heat transfer printing machine, an ink jet type printing device, or other direct printing type of station. Further, another embodiment may be the first processing station comprising a glue dispensing station and the second processing station comprising a label applicator that places the label onto the glue.

Although the number of objects attached to a bottle in the embodiment of FIG. 8 is two, any desired number of stations, as the device physically allows, can be used. The example of two labels is given only for exemplary purposes and it can be fully appreciated by persons skilled in the art that the same principles and concepts of the invention do encompass designs wherein the number of processing stations can be greater than two.

Figure 9:
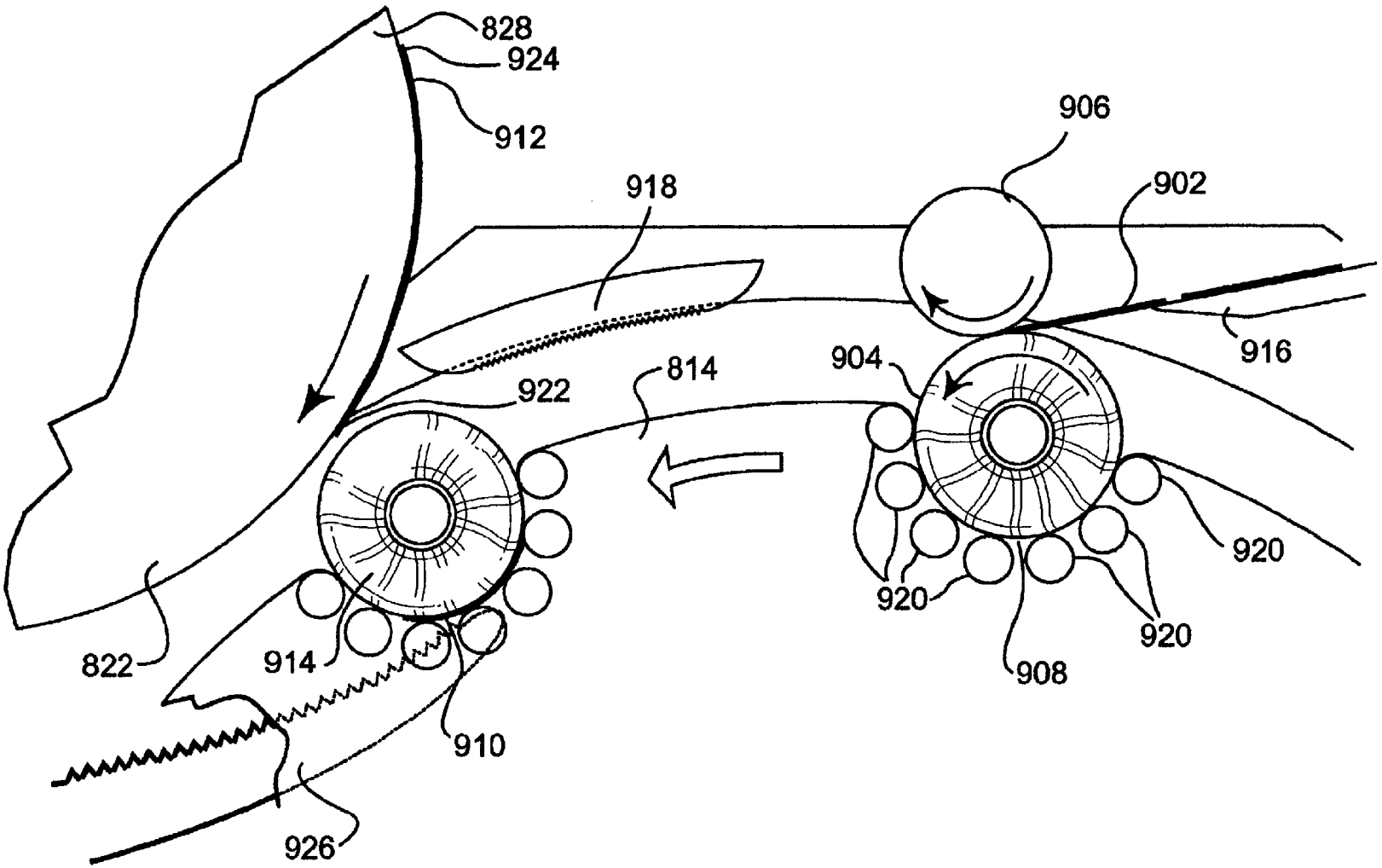
FIG. 9 is a detail view of a section of FIG. 8 showing the first label ready to be applied and the second label ready to be applied.

FIG. 9 shows a detail view of FIG. 8, showing the application of a first label 902 to bottle 904. A nip roller 832 rotates in a clockwise direction and spins the bottle 904 in a counter clockwise direction as it applies first label 902 to the bottle 904. The main star wheel 814 rotates in a counter clockwise direction and contains a plurality of cradles, of which first cradle 908 and 910 are shown. A second label 912 is shown just prior to being applied to bottle 914 at second label station 822.

The nip roller 832 is a powered roller that is geared to the rotation of main star wheel 814. As the bottle 904 advances towards the nip roller 906, a first label 902 is pinched between the bottle 904 and the nip roller 906. At this point, known as the nip point, the nip roller's clockwise rotation pulls the remainder of the first label 902 off of the web 916 and presses the first label 902 onto the bottle 904. The nip roller 832 may be mounted on a compliant mechanism so that it can travel outwardly as the bottle 904 passes underneath the nip roller 906. Alternatively, the surface of the nip roller 832 that contacts the bottle may be a compliant material, such as a foam rubber that will contact the bottle 904 as it passes underneath.

The gear ratio of the nip roller 832 to the main star wheel 814 is selected so that the first label 902 is fully applied to the bottle 904. The gear ratio of nip roller 832 to main star wheel 908 may be further increased or decreased to position the bottle 904 in a specific position before it engages the optional positioning pad 918. In this manner, the registration of the first label 902 to the second label is adjusted during machine set up and operation. As the speed of the machine increases, the effects of inertia when the bottle is spinning, friction in the cradles, and other elements combine to shift the registration of the first and second labels. By adjusting the gear ratio between the nip roller 832 and the main star wheel 814 as the speed increases, an operator or set up technician can adjust the registration of the two labels. It is common for the nip roller 832 to be controlled with a servo motor which is electronically geared to an input, such as an encoder on the main star wheel 814. Being electronically geared, the effective gear ratio can be caused to change with different parameters, including speed of the main star wheel 814.

An alternative method to a constant speed nip roller 832 is to change the speed of the nip roller 832 during the period that it is engaged with the bottle 904. For example, the nip roller 832 may begin so that the surface speed of the nip roller is the same as the surface speed of the bottle as it touches the nip point. After the label 902 is nipped between the nip roller 832 and the bottle 904, the nip roller 832 may be increased in speed to apply the label, and then it may be slowed down to the same speed as at the nip point. This speed profile leaves the bottle 904 in a state where it is not rotating in the cradle 908, which tends to minimize the inaccuracy of the registration of the first label to the second.

The cradle 908 has a recess and several rotation wheels 920. The wheels are designed so that the bottle 904 is free to rotate in the cradle 908 without being scratched or damaged. An alternative design would be to provide a slick, yet non-marring plastic as a cradle material.

Second label 912 is held to vacuum wheel 828. As vacuum wheel 828 is rotated in a clockwise direction and main star wheel 814 is rotated in a counter clockwise direction, the bottle 914 and second label 912 will meet. The second label 912 has adhesive applied to leading edge 922 and trailing edge 924 on the face of the second label 912 that faces away from vacuum drum 828. When the second label 912 comes in contact with bottle 914, the second label 912 will adhere to bottle 914. At the same point, bottle 914 will be forced against friction rail 926 and caused to rotate in a counter clockwise direction as it exits the cradle 910.

Figure 10:
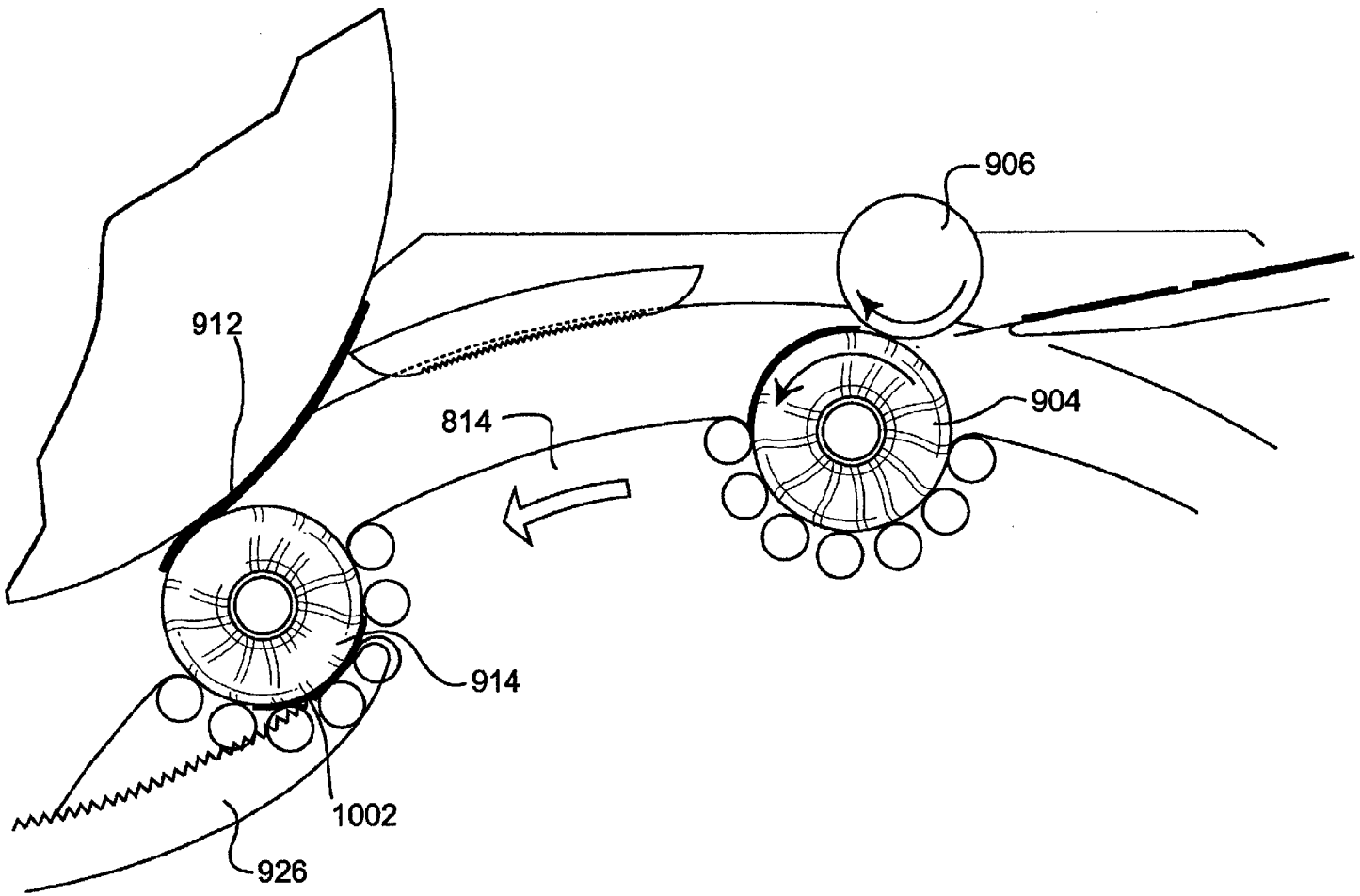
FIG. 10 is view similar to FIG. 9, but showing the bottle at the point where the first label is being applied and the bottle is being repositioned.

FIG. 10 illustrates a detail view of the embodiment 800 and similar to FIG. 9, except the main star wheel 814 has advanced to the point where the nip roller 832 is disengaging from bottle 904. Second bottle 914 has just past the nip point for the second label application. The position of second bottle 914 is such that its first label 1002 is positioned appropriately for the second label 912 to be applied.

Figure 11:
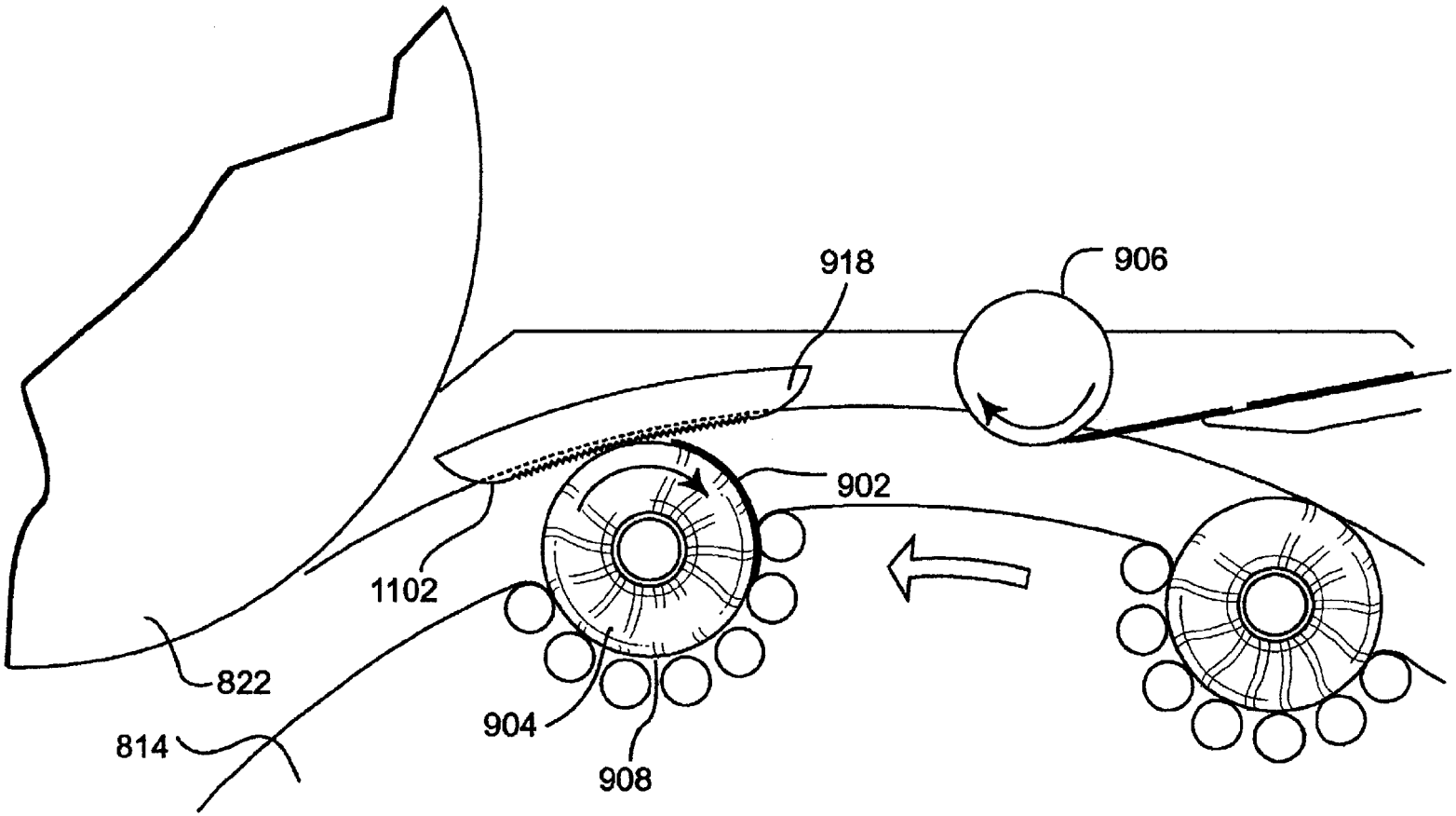
FIG. 11 is a view similar to FIG. 9, but showing the bottle being repositioned.

FIG. 11 shows a detail view of embodiment 800 and similar to FIGS. 9 and 10, except the main star wheel 814 has advanced to the point where the first bottle 904 is engaging the optional positioning pad 918. The optional positioning pad 918 is a fixed mounted fence that grips the surface of the bottle 904 and causes it to spin in a clockwise direction as the main star wheel 814 progresses in a counter clockwise direction. The length of engagement of the positioning pad 918 and the bottle 904 determines how much rotation the bottle 904 will undergo during the process. The material of the positioning pad 918 can be any material that frictionally grips the surface of the bottle 904, such as a rubber pad.

The disengagement point 1102 is generally selected to minimize the distance between the disengagement point 1102 and the second label station 822. This minimizes the period of time that the bottle 904 is unconstrained. The period that the bottle 904 is unconstrained is a contributor to the inaccuracy of the registration of the first label to the second. As the machine runs faster, the effects of inertia and friction of the bottle change the timing of the sequence and often changes the registration of the first label to the second. Correspondingly, the position and length of the optional positioning pad 918 may be optimized for a particular speed that the machine will run.

Positioning pad 918 may not be required in embodiment 800 if the rotation of nip roller 832 is sufficient to position the bottle 904 in cradle 908 in the proper location so that first label 902 is in the correct position to receive a second label. If the nip roller cannot reorient the bottle 904 to the correct position, an optional positioning pad 918 may be used.

Figure 12:
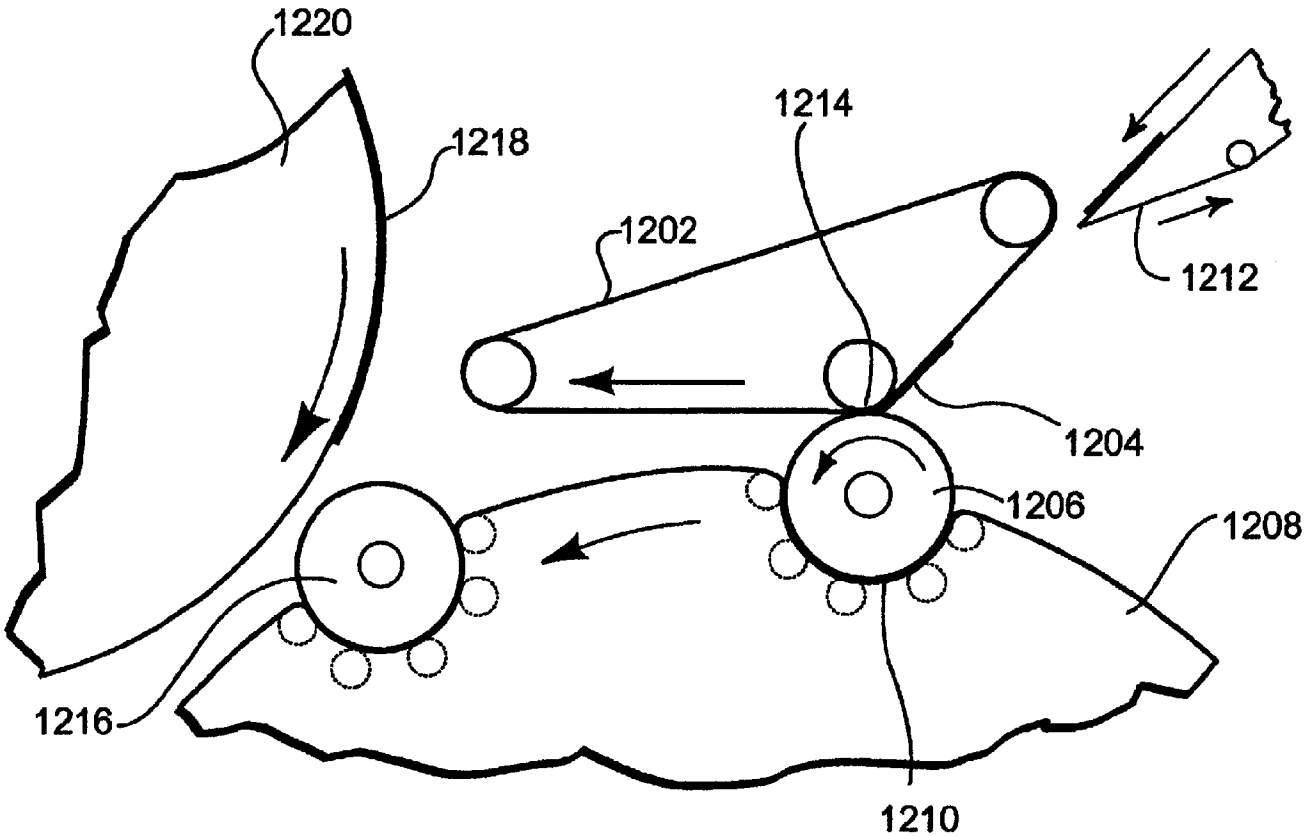
FIG. 12 is a detail view of a section of another embodiment of the invention showing an alternative method for delivering the first label and repositioning the bottle.

FIG. 12 illustrates an embodiment similar embodiment 100 except that the labels are dispensed onto a moving vacuum belt 1202 that serves to both place the label 1204 onto the bottle 1206 and further position the bottle 1206. The bottle 1206 is carried on main star wheel 1208 in cradle 1210 in a counter clockwise direction. The first label 1202 in this embodiment is a pressure sensitive adhesive backed label transported on a disposable web. The first label 1202 is peeled from the backing 1212 and presented against the vacuum belt 1202. The vacuum belt 1202 carries the first label 1204 to the nip point 1214 where the first label 1204 is pressed against the bottle 1206. The bottle 1216 is shown just prior to the point where second label 1218 is about to be placed onto bottle 1216. The second label 1218 is shown on vacuum wheel 1220.

The vacuum belt 1202 is a common method of transport for labels and the like. The construction is belt that has many holes through the surface of the belt. It rides over a track that has openings through which a vacuum is pulled. Light-weight articles with large surface area, such as labels and pieces of paper, are held to the belt as the belt moves.

The speed of the vacuum belt 1202 is greater than the surface speed of the bottle 1206 and causes the bottle 1206 to rotate counter clockwise, rolling the label 1204 to adhere to the bottle 1206. The extended length of the vacuum belt 1202 causes the bottle to rotate to a position where it is ready to accept a second label.

The gear ratio of vacuum belt 1202 to the main star wheel 1208 is selected so that the first label 1204 is fully applied to the bottle 1206 and positions the bottle 1206 in the cradle 1210 to accept a second label. The gear ratio of vacuum belt 1202 to main star wheel 1208 may be further increased or decreased to adjust the position of the bottle 1206 in the cradle. In this manner, the registration of the first label 1204 to the second label is adjusted during machine set up and operation. As the speed of the machine increases, the effects of inertia when the bottle is spinning, friction in the cradles, and other elements combine to shift the registration of the first and second labels. By adjusting the gear ratio between the vacuum belt 1202 and the main star wheel 1208 as the speed increases, an operator or set up technician can adjust the registration of the two labels. It is common for the vacuum belt 1202 to be controlled with a servo motor which is electronically geared to an input, such as an encoder on the main star wheel 1208. Being electronically geared, the effective gear ratio to change with different parameters, including speed of the main star wheel 1208.

An alternative method to a constant gear ratio vacuum belt 1202 is to change the speed of the vacuum belt 1202 during the period that it is engaged with the bottle 1206. For example, the vacuum belt 1202 may begin so that the surface speed of the vacuum belt 1202 is the same as the surface speed of the web 1212 for the pick up of the label. The speed of the vacuum belt 1202 may be increased to match the surface speed of the bottle 1206 as it touches the nip point 1214. After the label 1204 is nipped between the vacuum belt 1202 and the bottle 1206, the vacuum belt 1202 may be increased in speed to apply the label and position the bottle 1206, and then it may be slowed down to the same speed as at the nip point. This speed profile leaves the bottle 1206 in a state where it is not rotating in the cradle 1210, which tends to minimize the inaccuracy of the registration of the first label to the second.

Those skilled in the art of machine design can appreciate that the positioning device may be incorporated into one or more of the processing stations or may be a separate device mounted on the machine. The positioning mechanisms may be stationary, such as a frictional fence, or the positioning mechanisms may be powered devices, such as a moving wheel or belt. Further, the powered devices may incorporate variable speed profiles, sensors, and feedback loops for advanced control. The examples were chosen to best exemplify the invention and those skilled in the art of machine design may find alternative embodiments without deviating from the scope of the invention.

Further embodiments of the present invention include the assembled bottles with the combinations of labels that heretofore were unproducible.

Figure 13:
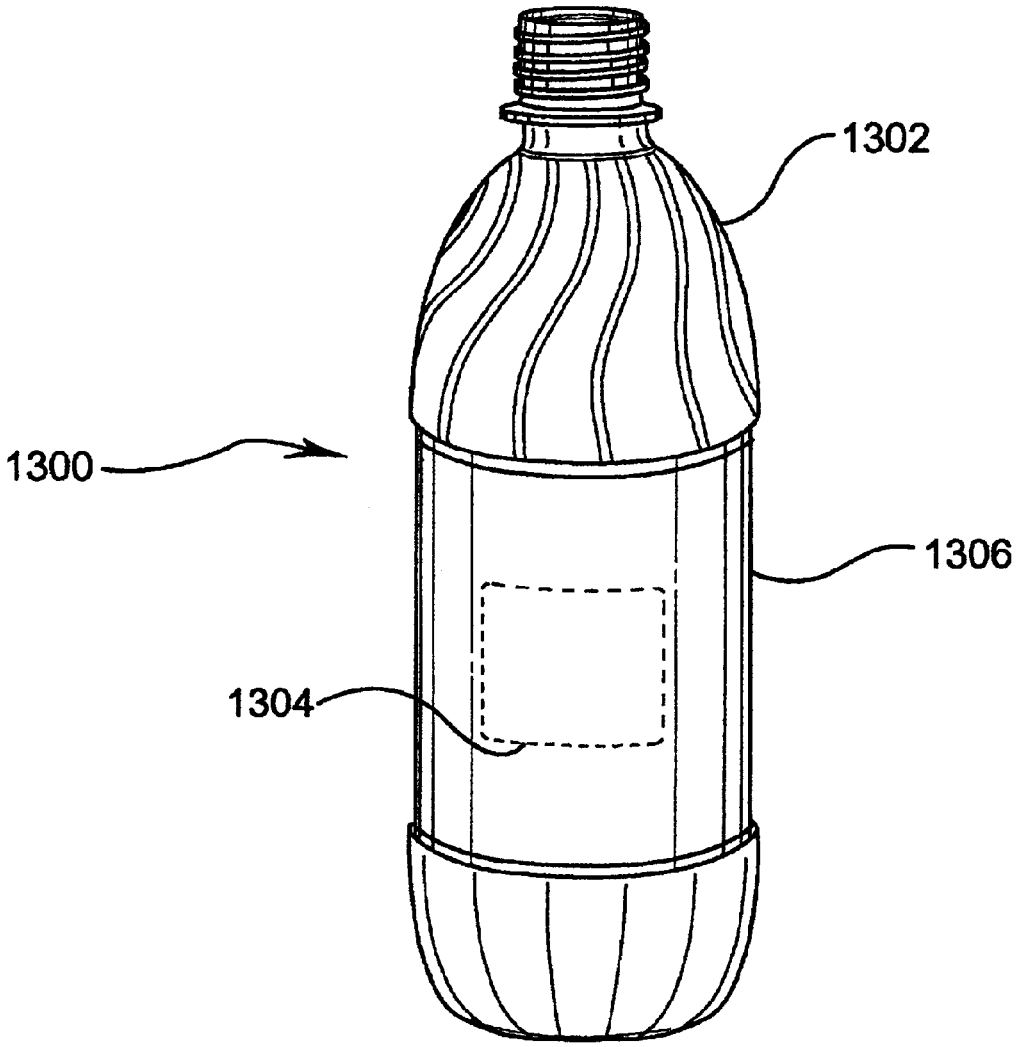
FIG. 13 is an illustration of an embodiment of the inventive label configuration wherein a first label is hidden by a second label.

FIG. 13 illustrates a perspective view of an embodiment of an inventive label configuration 1300 of the present invention having two labels applied to a bottle. The bottle 1302 has the first label 1304 underneath the second label 1306.

Figure 14:
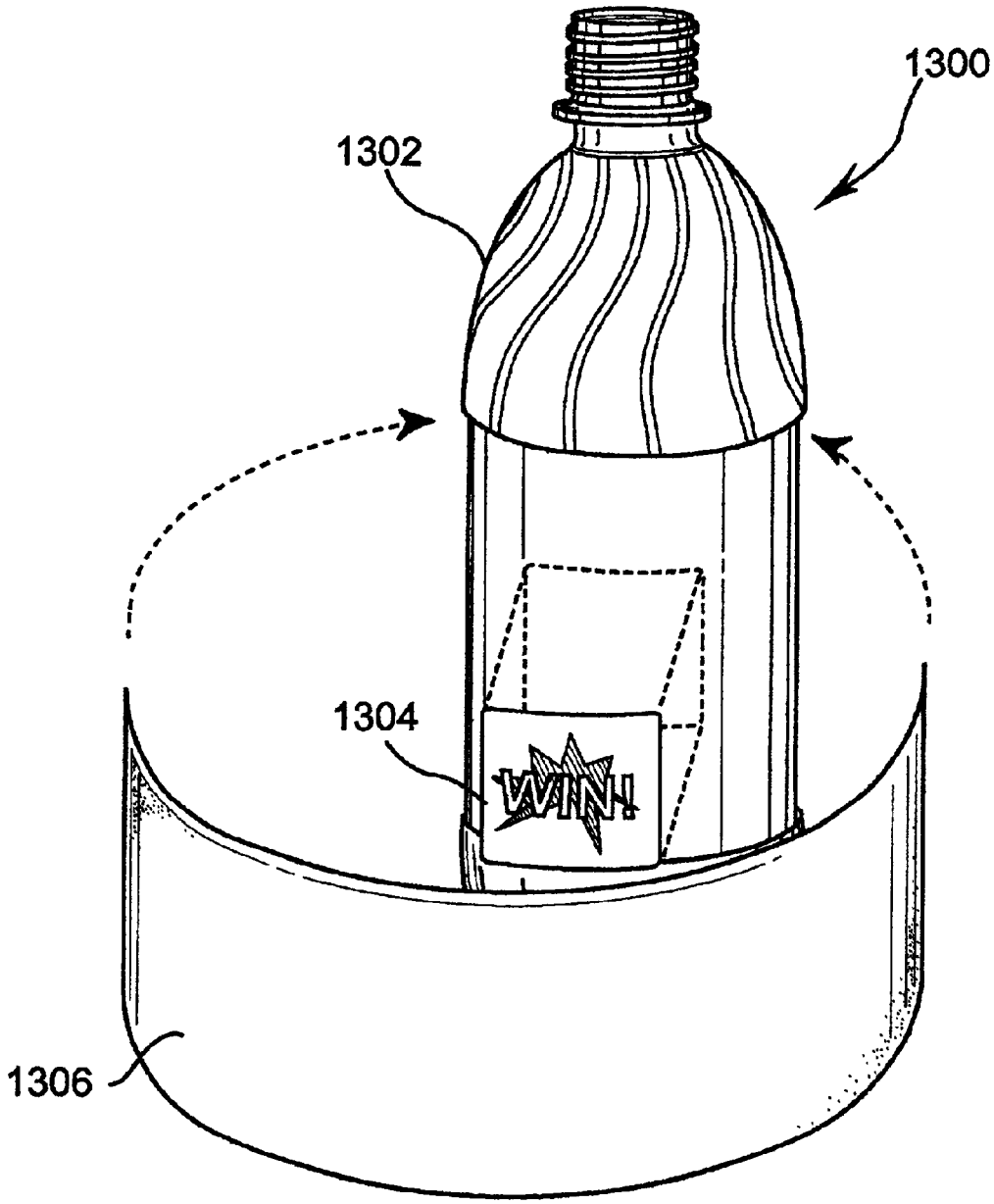
FIG. 14 is a perspective view of FIG. 13 shown in the exploded state.

FIG. 14 illustrates an exploded view of embodiment 1300. First label 1304 is placed on bottle 1302 and second label 1306 is placed over first label 1304. Embodiment 1300 maybe, for example, a promotional device wherein first label 1304 is a game piece, ticket, or other premium that is hidden from the consumer. The consumer must remove the second label 1306 to gain access to the game piece 1304. The position of second label 1306 with respect to first label 1304 is only critical so that the edges of second label 1306 do not overlap the first label 1304, if, for example, the second label 1306 were attached by glue only at the edges. The glued edges would interfere with the removal of first label 1304. If this were to happen, the consumer may have difficulty removing the first label 1304 from the bottle 1302.

Embodiment 1300 may, for example, comprise a first label 1304 that is an adhesive backed passive electronic antenna that is covered by second label 1306. The thickness of first label 1304 may interfere with the gluing or placement mechanism used for second label 1306 and the proper registration of the two labels with respect to each other may be for manufacturing reasons and not necessarily cosmetic or other functional reasons. In these cases, the acceptable placement tolerance may be as large or larger than plus or minus 2 inches or as small as plus or minus 0.001 inches for example.

Another embodiment 1300 may comprise an active electronic device, such as a battery powered circuit comprising a switch, a speaker, and circuitry to play a sound when the switch is activated. The electronic device may be placed on a bottle and surrounded by a label so that the label completely covers the device. The device may then be activated by pressing the switch through the over wrapping label.

Another embodiment 1300 may consist of the first label 1304 as a game code printed to the bottle 1302 and the second label 1306 may be placed over the first label 1304 to hide the game code from the player. The number of objects attached to the bottle 1302 in the inventive device is not limited to two. Any number of items may be attached to bottle 1302 which each require registration with respect to each other. The example of two labels is given only for exemplary purposes and it can be fully appreciated by persons skilled in the art that the same principles and concepts of the invention do encompass designs wherein numbers of items greater than two are applied to an object. For example, a bottle may have a game piece attached, a printed code at a second location on the bottle, then a label with graphics overlaying the first two items.

Figure 15:
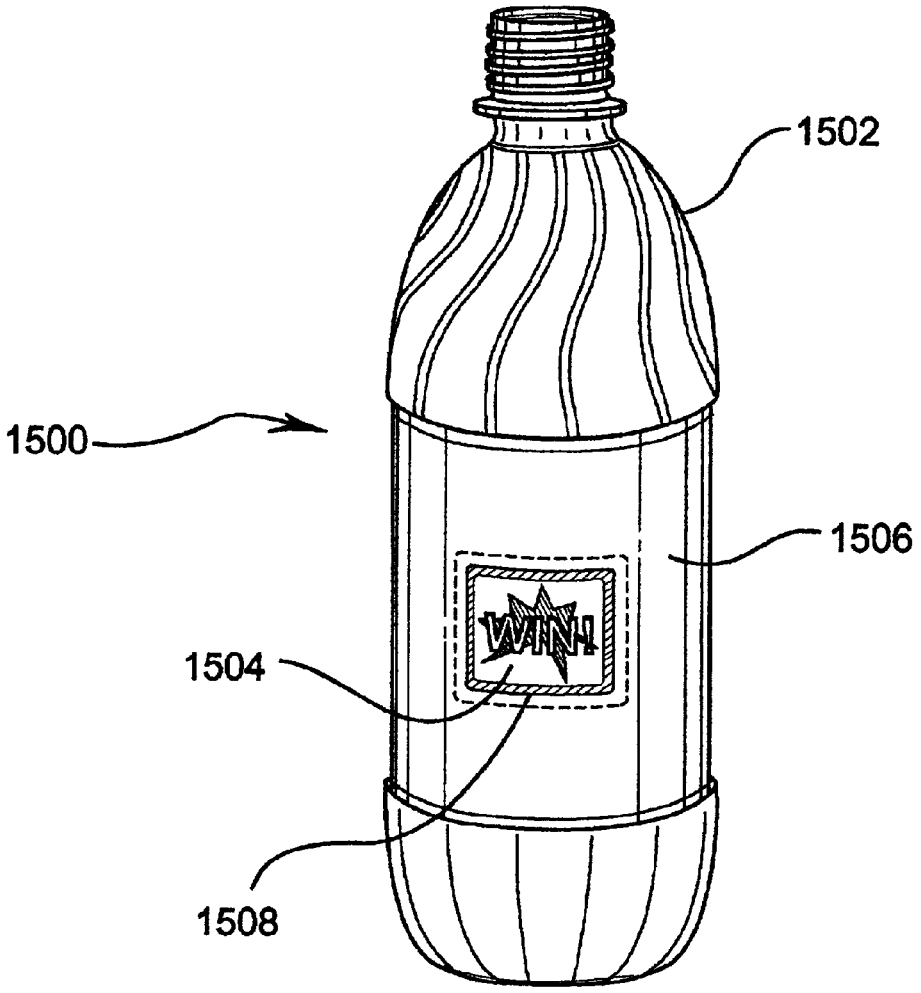
FIG. 15 is a perspective view of another embodiment of the inventive label configuration of the present invention having a first label and a second label with a window aligned with the first wherein one or more edges of the first label are exposed through the window.

FIG. 15 illustrates a perspective view of an embodiment of an inventive label configuration 1500 of the present invention having two labels. The container 1502 has the first label 1504 underneath the second label 1506, and the second label 1506 has a window 1508 so that the first label 1504 is readily viewable through the second label 1506.

Figure 16:
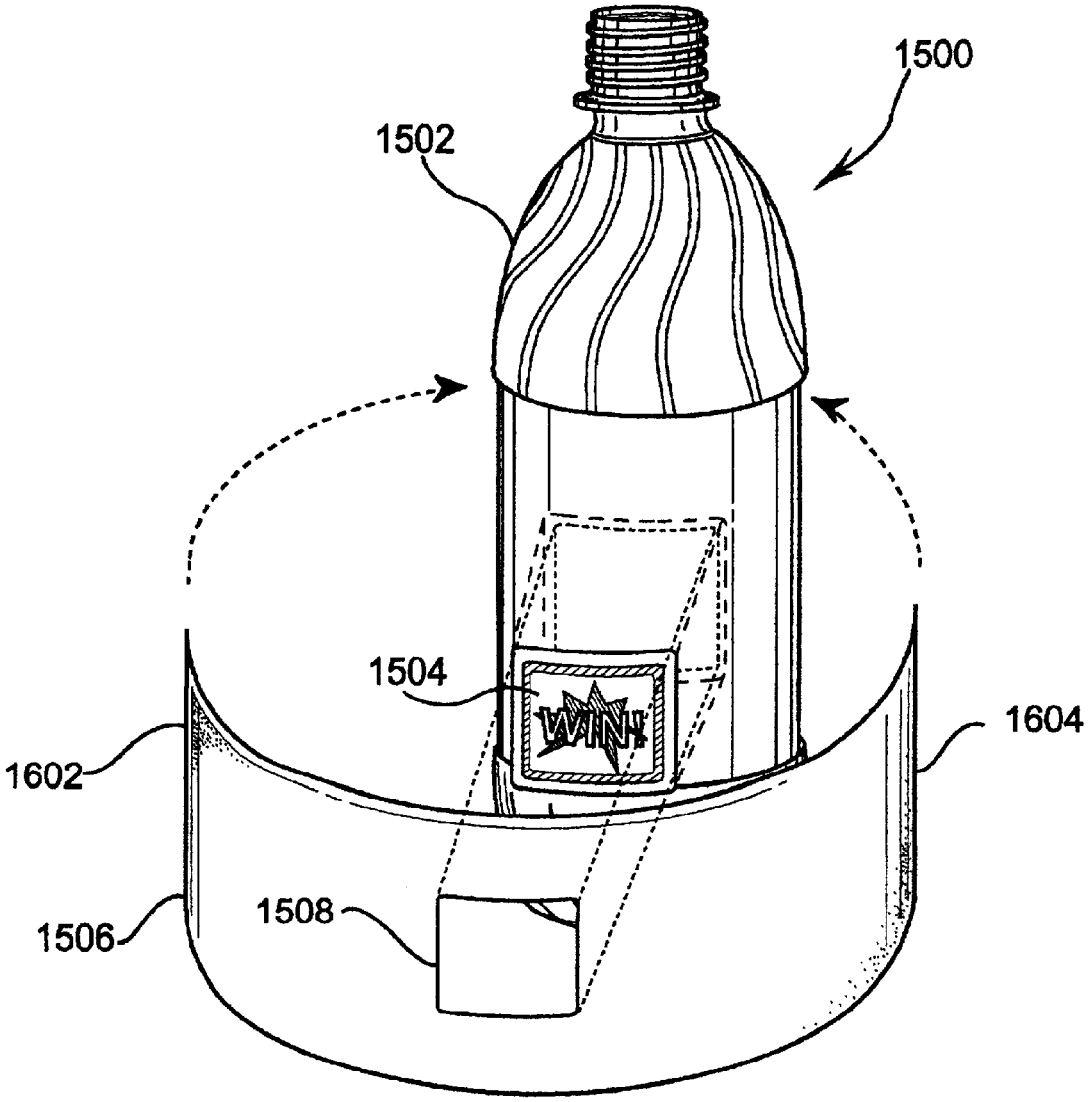
FIG. 16 is a perspective view of FIG. 15 shown in the exploded state.

FIG. 16 illustrates an exploded view of embodiment 1500. First label 1504 is placed onto bottle 1502 and second label 1506 is placed over first label 1504 and registered such that a portion of first label 1504 is viewable through window 1508.

The window 1508 may be manufactured by several methods. For a label that is manufactured from a material that is clear, such as a clear plastic film, the window area may be manufactured by selectively not printing any ink across the area defined by the window. Another method, which is applicable to label material that is either opaque or clear, is to die cut and remove the label material in the area of the window. In the case where second label 1506 is printed directly on the bottle, the window 1508 may be created by selectively not printing ink in the area of window 1508. The window 1508 may be clear, tinted, or selectively tinted through the manufacturing process of the second label 1506. The size and shape of the window 1508 may be varied widely, including rectangular, circular, or any arbitrary shape.

The second label 1506 may completely cover the first label 1504 as shown in embodiment 1500, or may have one or more or all edges of first label 1504 exposed through the window 1508. The registration of first label 1504 and second label 1506 should be sufficient so that the area of first label 1504 that is designed to be exposed through window 1508 is properly shown through the window 1508.

The second label 1506 may entrap the first label 1504 by several methods, regardless of the method of attaching first label 1504. The second label 1506 may encircle the first label 1504 by purely mechanical means, such as a roll wrapped label which has glue applied to a small strip along edges 1602 and 1604. An alternative design, applicable to second labels which have a through hole construction for window 1508, would be to coat the entire inner surface of second label 1506 with adhesive to adhere second label 1506 to bottle 1502, but also adhere second label 1506 to first label 1504 in the areas of overlap.

The interaction of the first label 1504 and second label 1506 with respect to the window 1508 takes on many forms. For example, a printed date code may be applied to a container and a label with a window may be positioned so that the date code is visible through the window. Another example would be a game piece or promotion first applied to a bottle, then a second label entraps the game piece with a window through which the game piece is displayed. Further, a first label may be applied which contains bright graphics and a second label with additional graphics applied to a semi transparent film may be applied over the first label as an additional graphic element and to serve as a protective cover to the first label. Another example is the application of a printed color background over which is applied a translucent label with graphics printed in the foreground, giving the visual effect of depth to the label. Further, a second label that is translucent and contains promotional information may be placed over a first label that is the standard label for the product. Another example is the application of a printed game code using a sprayed ink printed which is viewed through a window on a wrap around label, the game code being selectively changed during the production run. Further, a passive electronic device, such as a passive RF identification tag with a date code printed on the outside, may be first placed on the bottle and registered to a window in a label that entraps the tag. Another example has an active electronic device, such as a device with a small battery and a light emitting diode for example, which is placed on the bottle so that a label with a cut out window allows the light emitting diode to show through. Further, the active electronic device may comprise a battery, a switch, a speaker, and circuitry adapted to play an audio recording. The registration tolerance for embodiment 1500 may be as tight as plus or minus 0.001 inches or as loose or looser than plus or minus 2 inches, depending on the construction and design of the components and the assembly method.

The number of objects attached to the bottle 1502 in the inventive device is not limited to two. Any number of items may be attached to bottle 1502 which each require registration with respect to each other. The example of two labels is given only for exemplary purposes and it can be fully appreciated by persons skilled in the art that the same principles and concepts of the invention do encompass designs wherein numbers of items greater than two are applied to an object. For example, a bottle may have a graphical image printed directly on the bottle, a game piece attached, then a translucent label with graphics overlaying the first graphics and a window through which the game piece is removable.

Figure 17:
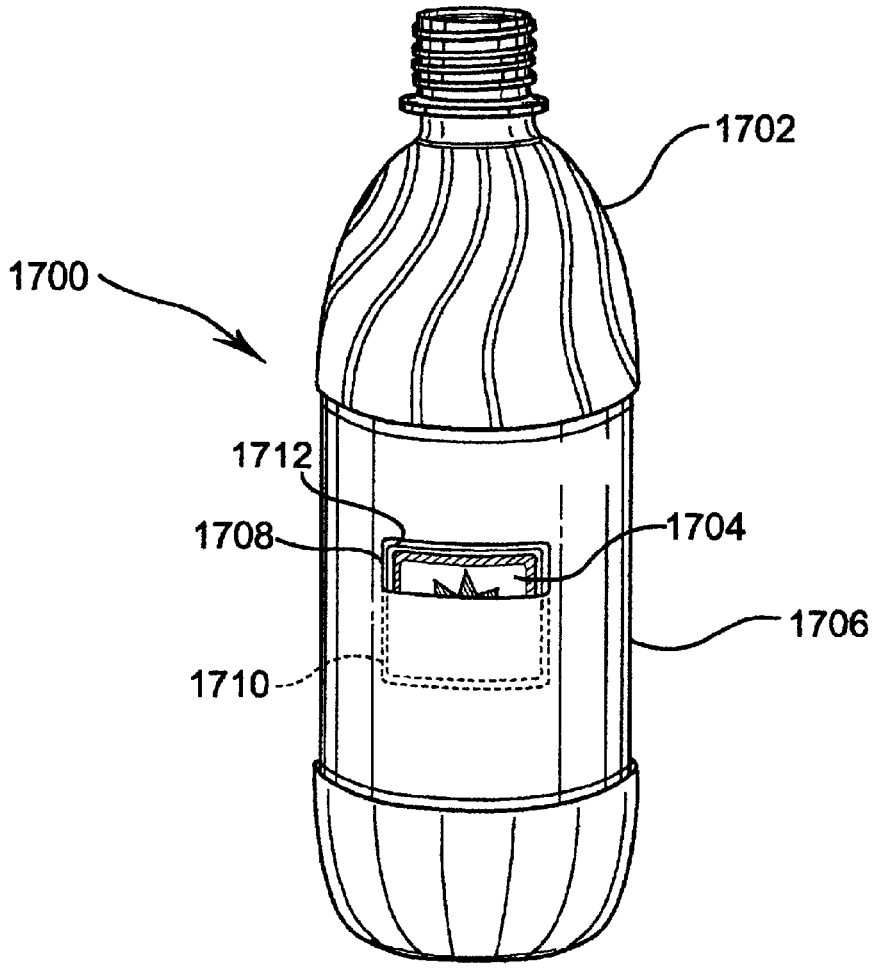
FIG. 17 is perspective view of an embodiment of the inventive label configuration of the present invention having a portion of a first label appear through a window in a second label.

FIG. 17 illustrates a perspective view of an embodiment of inventive label configuration 1700 illustrating a bottle 1702 with a first label 1704 exposed through a window 1708 of second label 1706. Assembly 1700 illustrates the first label 1704 with one edge exposed through window 1708 and typifies an example where the first label 1704 is a promotional game piece to be opened by a consumer after purchase. An optional perforated or scored line 1710 may be created to aid in the removal of the first label 1704.

Figure 18:
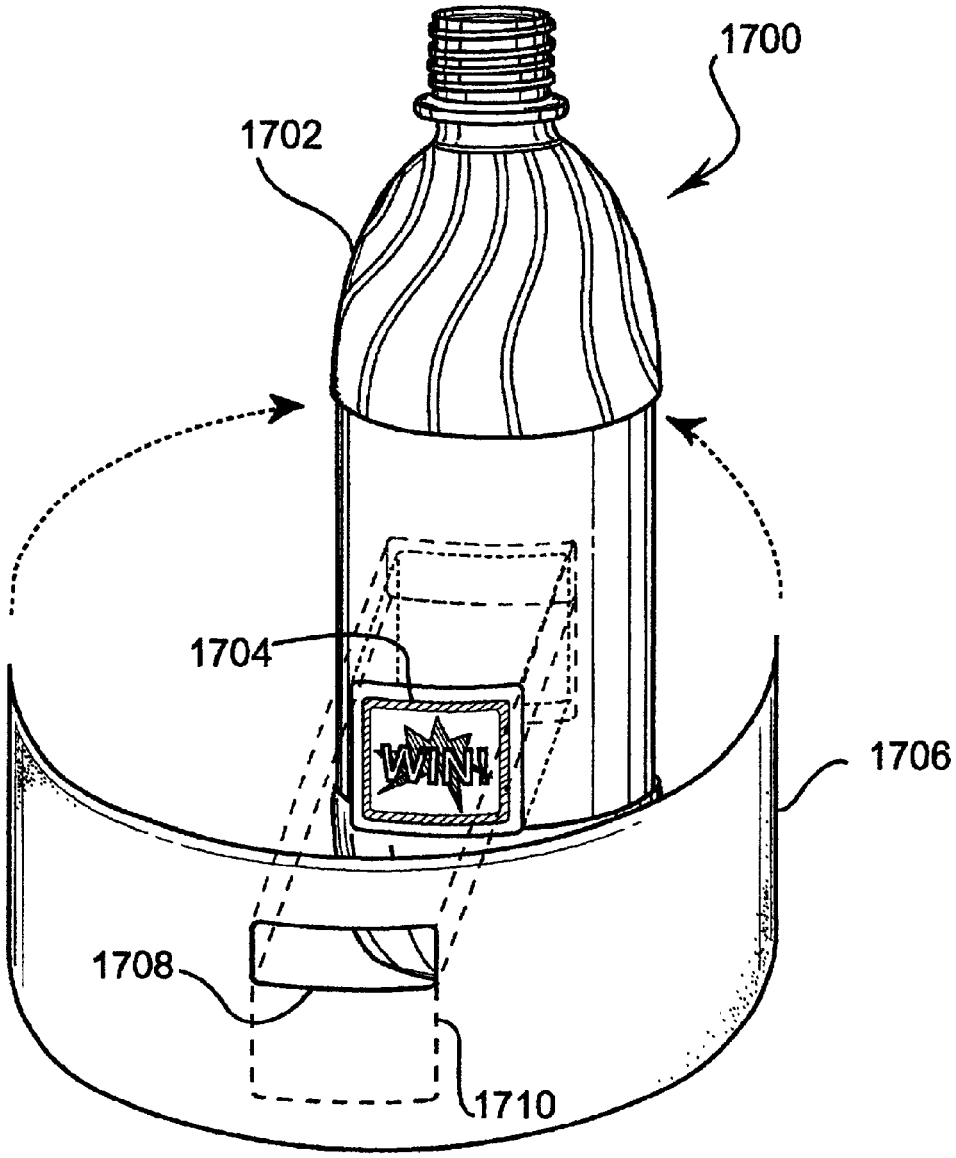
FIG. 18 is a perspective view of FIG. 17 shown in the exploded state.

FIG. 18 illustrates an exploded view of embodiment 1700. First label 1704 is assembled to bottle 1702 and second label 1706 is assembled over first label 1704 and registered such that first label 1704 may be viewable through window 1708.

The first label 1704 may optionally not have adhesive near the edge 1712 so that the consumer can slide a fingernail under the first label 1704 as they remove the first label 1704. Further, the first label 1704 may optionally not have adhesive at all between it and bottle 1702. In this case, first label 1704 may be applied by static charge or other mechanical method until the second label 1706 entraps first label 1704. The second label 1706 may optionally have any adhesive selectively removed in the overlapping areas between second label 1706 and first label 1704, which effectively forms a pocket for label 1704. An alternative embodiment would be to use a shrink-wrap construction for second label 1706, which would hold first label 1704 and form a pocket. Another example is the first label being a printed game code first applied to a bottle and a second label placed so that the printed game code is beneath the area defined by the perforated line 1710 such that the consumer must remove the perforated area defined by line 1710 to play the game. These embodiments may be useful for applications where first label 1704 is, for example, an instruction booklet that could be removed and replaced several times during the use of the product. The registration tolerance for embodiment 1700 may be as tight as plus or minus 0.001 inches or plus or minus ⅛ inch for example. The tolerance may be larger or smaller based on the application.

The number of objects attached to the bottle 1702 in the inventive device is not limited to two. Any number of items may be attached to bottle 1702 which each require registration with respect to each other. The example of two labels is given only for exemplary purposes and it can be fully appreciated by persons skilled in the art that the same principles and concepts of the invention do encompass designs wherein numbers of items greater than two are applied to an object. For example, a game code may be printed on a bottle, then a promotional game piece is applied above the printed code, then a label may be wrapped over the game piece with a window through which the game piece can be removed.

Figure 19:
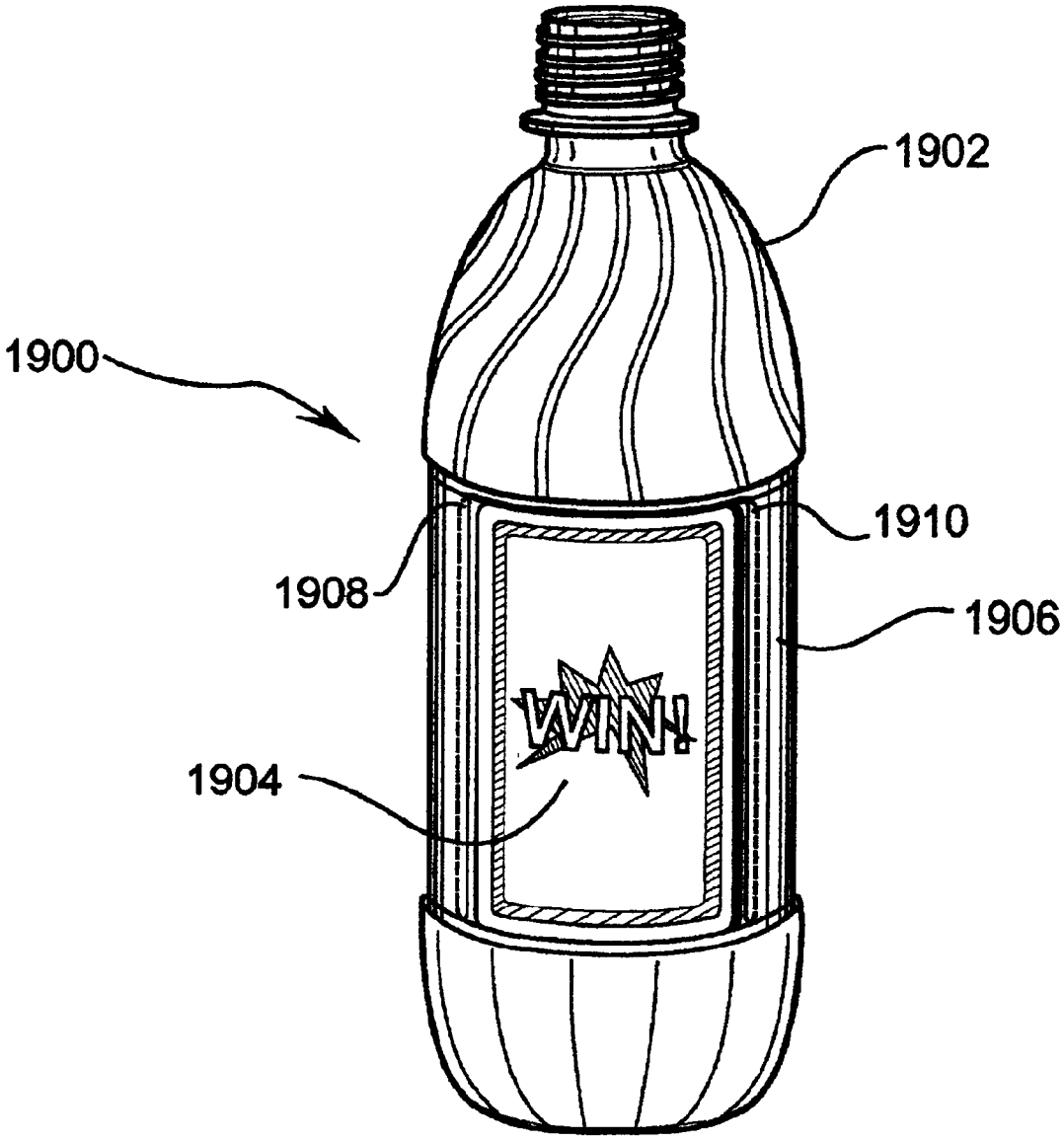
FIG. 19 is a perspective view of another embodiment of the inventive label configuration of the present invention having a first label and a second label wherein the second label attaches to one end of the first label and wraps around to attach to the opposite end of the first label.

FIG. 19 illustrates a perspective view of an embodiment of the inventive label configuration 1900 showing a bottle 1902, a first label 1904, and a second label 1906. The first label 1904 is attached to bottle 1902, and then the second label 1906 is applied starting at the tab area 1908 on first label 1904 and continuing around the bottle 1902 until the other end is attached to tab area 1910.

Figure 20:
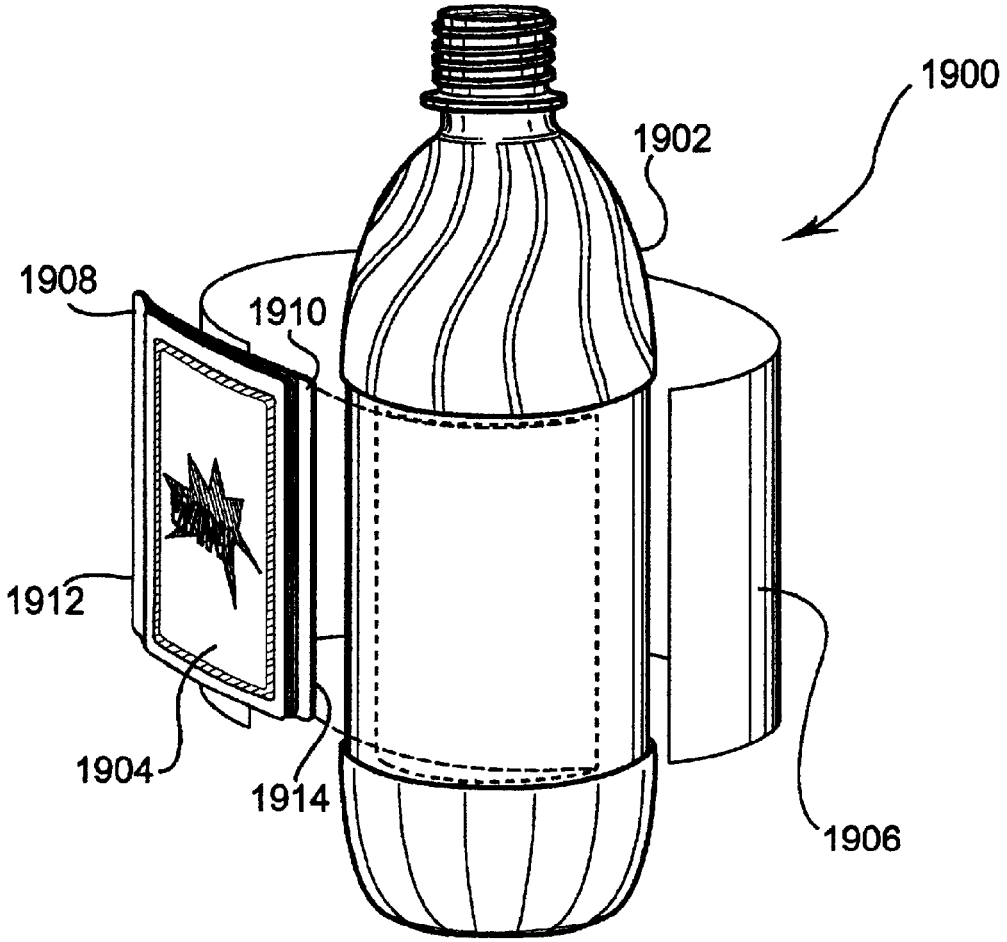
FIG. 20 is a perspective view of FIG. 19 shown in the exploded state.

FIG. 20 illustrates an exploded view of embodiment 1900. First label 1904 is applied to bottle 1902, then second label 1906 is applied, covering first label 1904 in tab area 1908 and continuing around bottle 1902 until tab area 1910 is covered.

Figure 21:
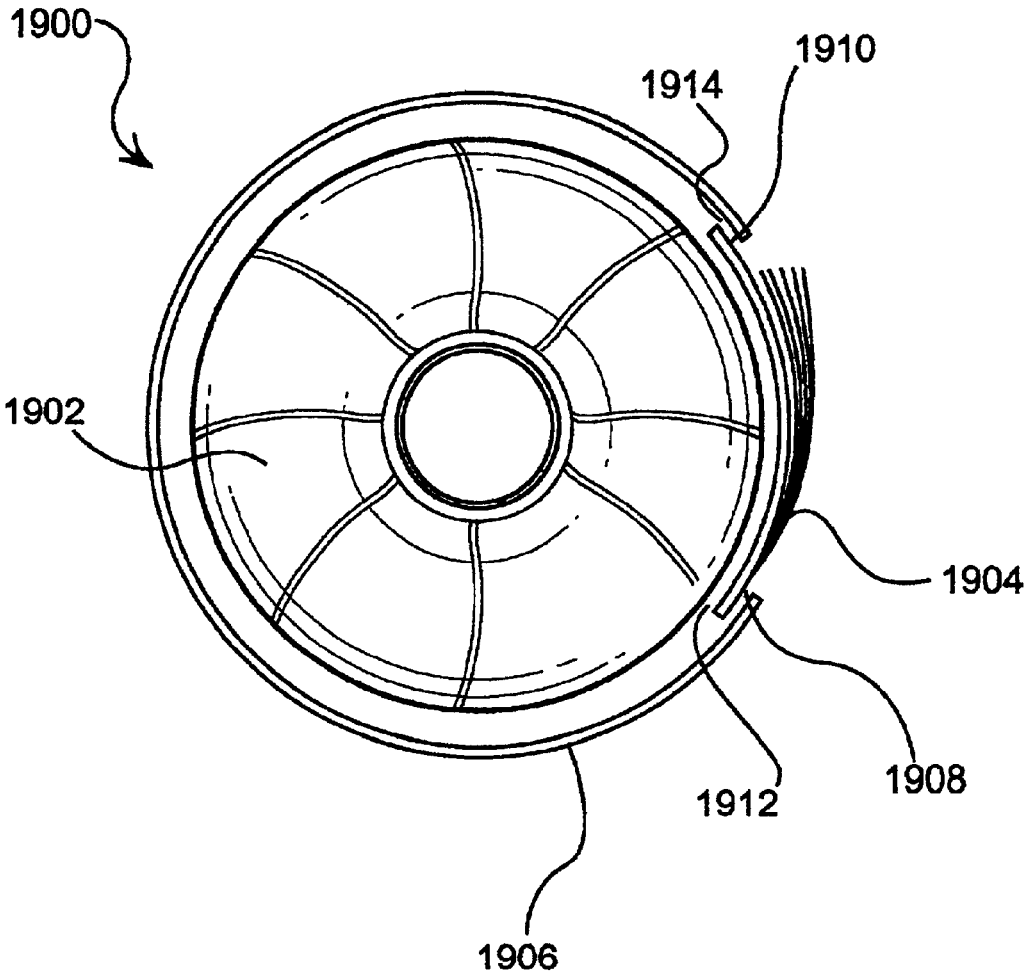
FIG. 21 is a top view of the embodiment of FIG. 19 shown with each element slightly exploded.

FIG. 21 illustrates a top view of embodiment 1900 shown slightly exploded.

Embodiment 1900 shows first label 1904 as an instructional booklet and the second label 1906 as a plastic film roll wrap label. Another embodiment may be to have the second label 1906 attach directly to bottle 1902 and with its ends either touching or some distance away from the edges 1912 and 1914, without overlapping onto first label 1904. Further, another embodiment may comprise a first label 1904 that is printed directly onto bottle 1902 and a second label 1906 of any construction that is subsequently applied. Another embodiment may be to have the first label 1904 comprise adhesive on the exterior surface in the areas where the second label 1906 overlaps the first label 1904.

The number of objects attached to the bottle 1902 in the inventive device is not limited to two. Any number of items may be attached to bottle 1902 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment of three items attached to a bottle would be an RF identification tag applied to the bottle with pressure sensitive adhesive, an instructional booklet applied with pressure sensitive adhesive on the position on the opposite side of the bottle from the RF identification tag, and a roll wrapped label that covers the RF identification tag but leaves the instructional booklet exposed.

Figure 22:
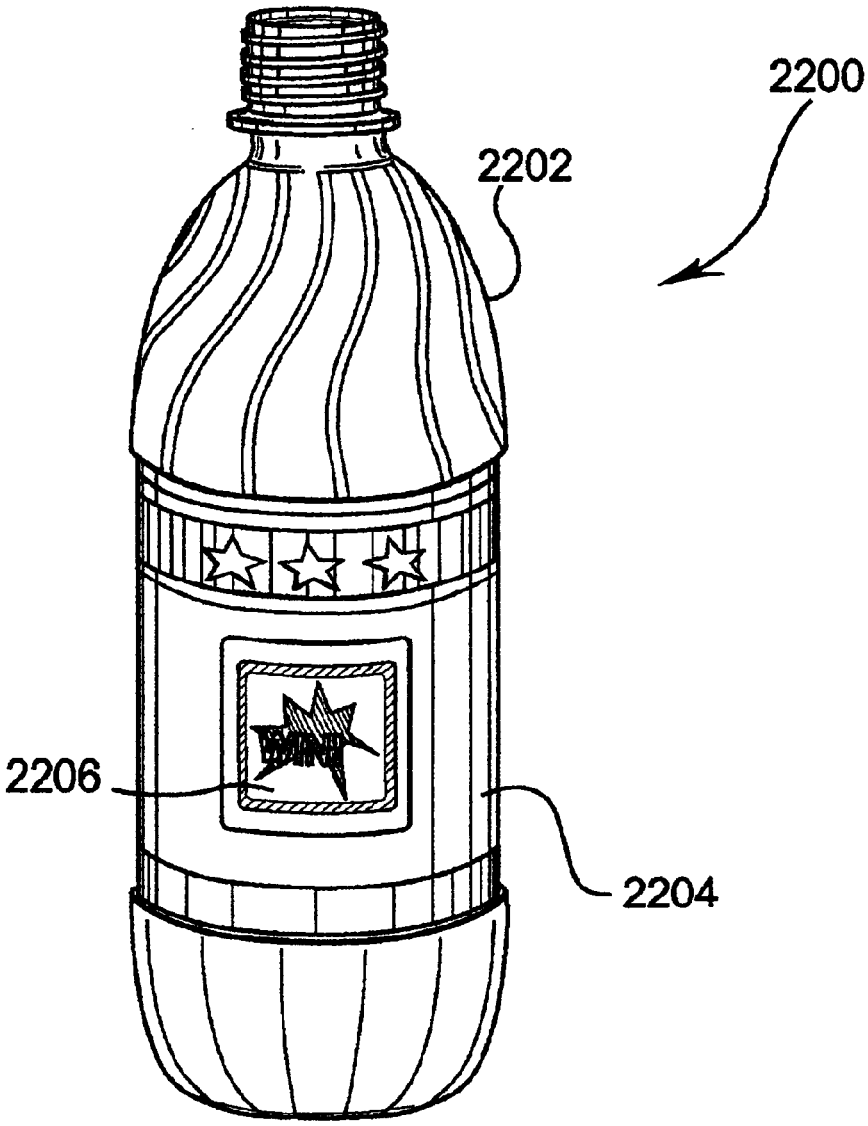
FIG. 22 is a perspective view of an embodiment of the inventive label configuration of the present invention having a first label and a second label wherein the second label is attached to the outside of the first label.

FIG. 22 illustrates a perspective view of an embodiment of the inventive label configuration 2200 showing a bottle 2202, a first label 2204, and a second label 2206. The first label 2204 is attached to bottle 2202, and then the second label 2206 is placed so that it covers a portion of first label 2202.

Figure 23:
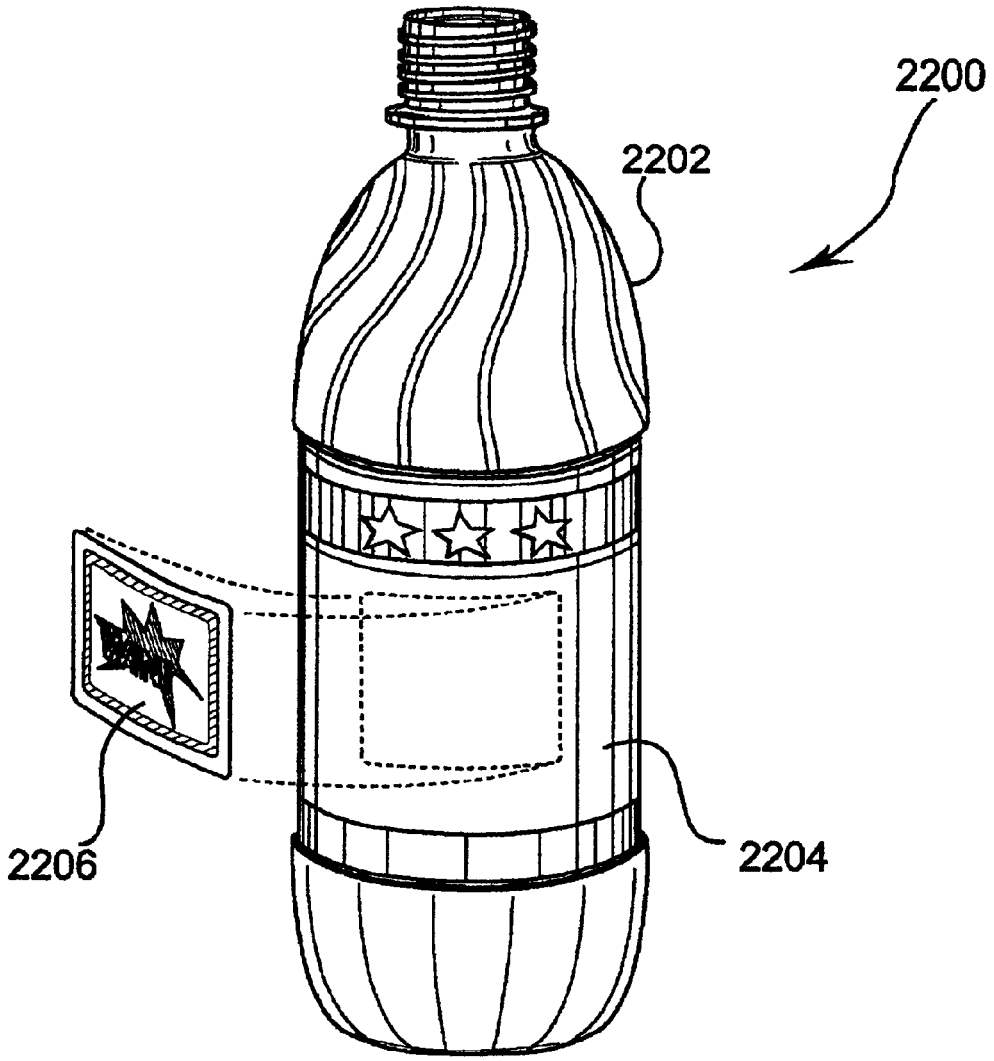
FIG. 23 is a perspective view of FIG. 22 shown in the exploded state.

FIG. 23 illustrates an exploded view of embodiment 2200. First label 2204 is assembled to bottle 2202 then second label 2206 is assembled so that a portion of second label 2206 covers all or a portion of first label 2204 and occupies a specific location on top of first label 2204.

Embodiment 2200 may have the first label 2204 as a roll wrapped label or other large label with brand identification. The second label 2206 may be a game token, coupon, or other promotional item, or the second label 2206 may be a second label designed to make the product catch a consumer's eye, such as a hologram, diffraction grating, or other label type. Alternatively, the second label 2206 may be a web converted item, such as a phone card, ticket, game token, or other promotional item that has been attached to a carrier, the carrier being attached directly to first label 2204 and facilitating removal of the promotional item. Further, the second label 2206 may comprise a package for holding a liquid or other items.

The number of objects attached to the bottle 2202 in the inventive embodiment 2200 is not limited to two. Any number of items may be attached to bottle 2202 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment with three items would be to place a roll wrapped label onto a bottle, then place a holographic label onto a specific location on the first label, followed by a promotional game piece onto the first label in a second specific location.

Figure 24:
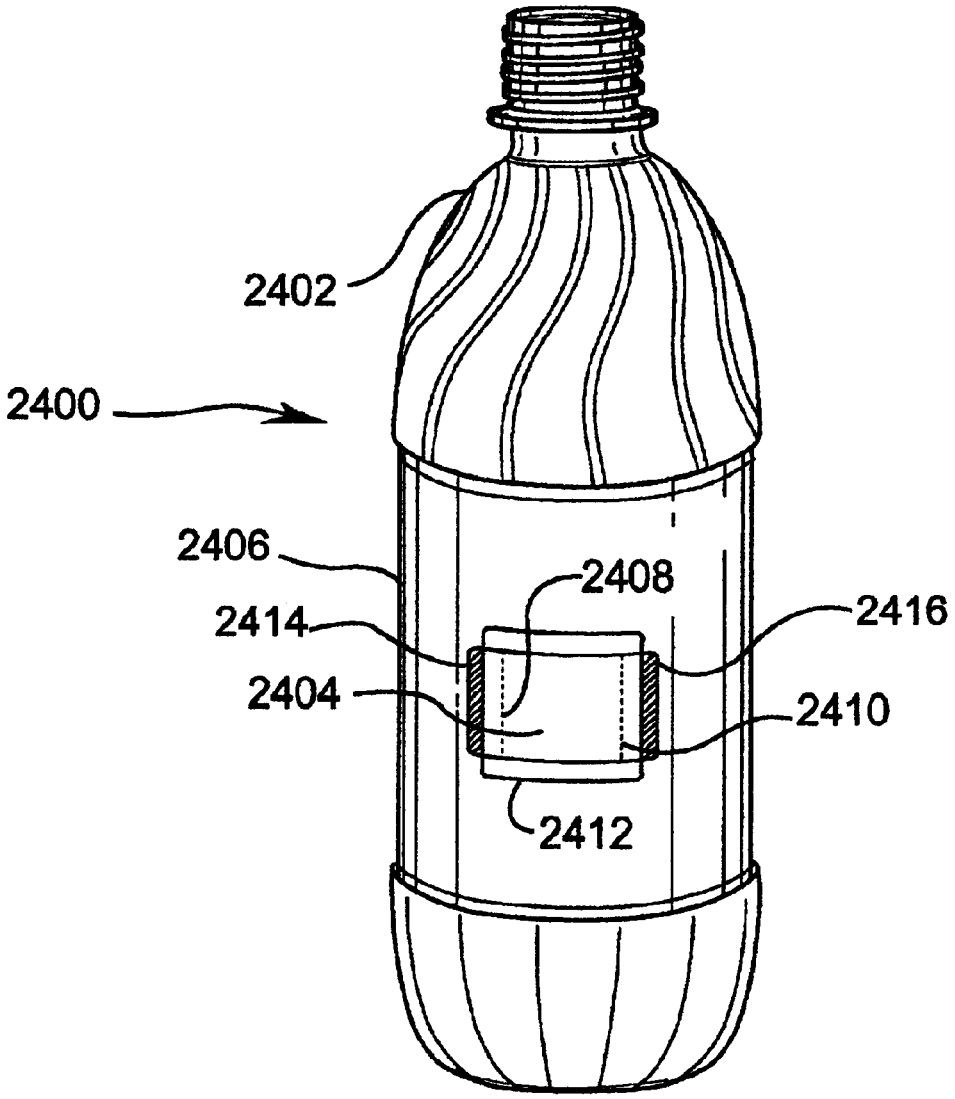
FIG. 24 is a perspective view of an embodiment of the inventive label configuration of the present invention wherein a first label is viewable through a window in a second label and two edges of the first label are exposed through the window.

FIG. 24 illustrates a perspective view of embodiment of the inventive label configuration 2400 that comprises a bottle 2402, a first label 2404, and a second label 2406. The first label 2404 further comprises two perforated lines 2408 and 2410. The window 2412 is a hole formed by cutting away and removing material from the second label 2406.

Figure 25:
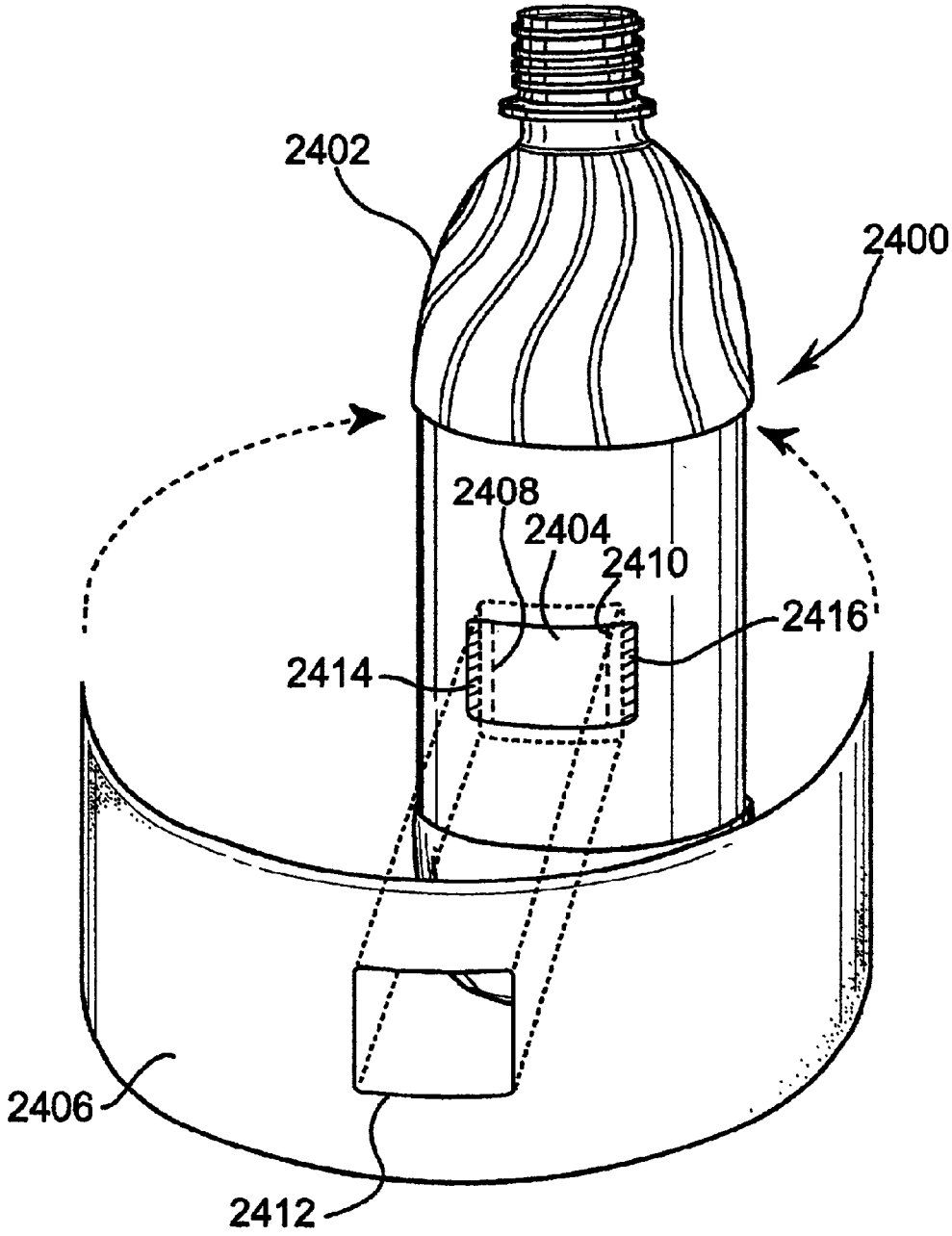
FIG. 25 is a perspective view of FIG. 24 shown in the exploded state.

FIG. 25 illustrates an exploded view of embodiment 2400. First label 2404 is attached to bottle 2402, then second label 2406 is attached to bottle 2402 such that at least a portion of first label 2404 is viewable through window 2412.

In embodiment 2400, first label 2404 is embodied as a game piece, coupon, phone card, ticket, or other promotional item that is designed for the consumer to remove. For example the promotional item may be a multi-ply label that contains the perforated lines 2408 and 2410. The consumer would use a fingernail to peel off the outer ply of the game piece that would separate at perforated lines 2408 and 2410. Further, first label 2404 may have adhesive selectively applied only under the areas 2414 and 2416 that are outside of the perforated area, better enabling the consumer to remove the center portion of the first label 2404 without damaging the second label 2406.

Another embodiment 2400 may comprise a first label 2404 that is a liquid filled packet that has been attached to a paper or other type of backing, the backing being attached to the bottle 2402. The consumer would then remove the liquid packet portion of first label 2404.

The number of objects attached to the bottle 2402 in the inventive embodiment 2400 is not limited to two. Any number of items may be attached to bottle 2402 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment with three items could be to place a passive electrical device and a game piece on a bottle, then place an overwrapping label that covers the electrical device, but leaves the game piece exposed through a window in the overlapping label.

Figure 26:
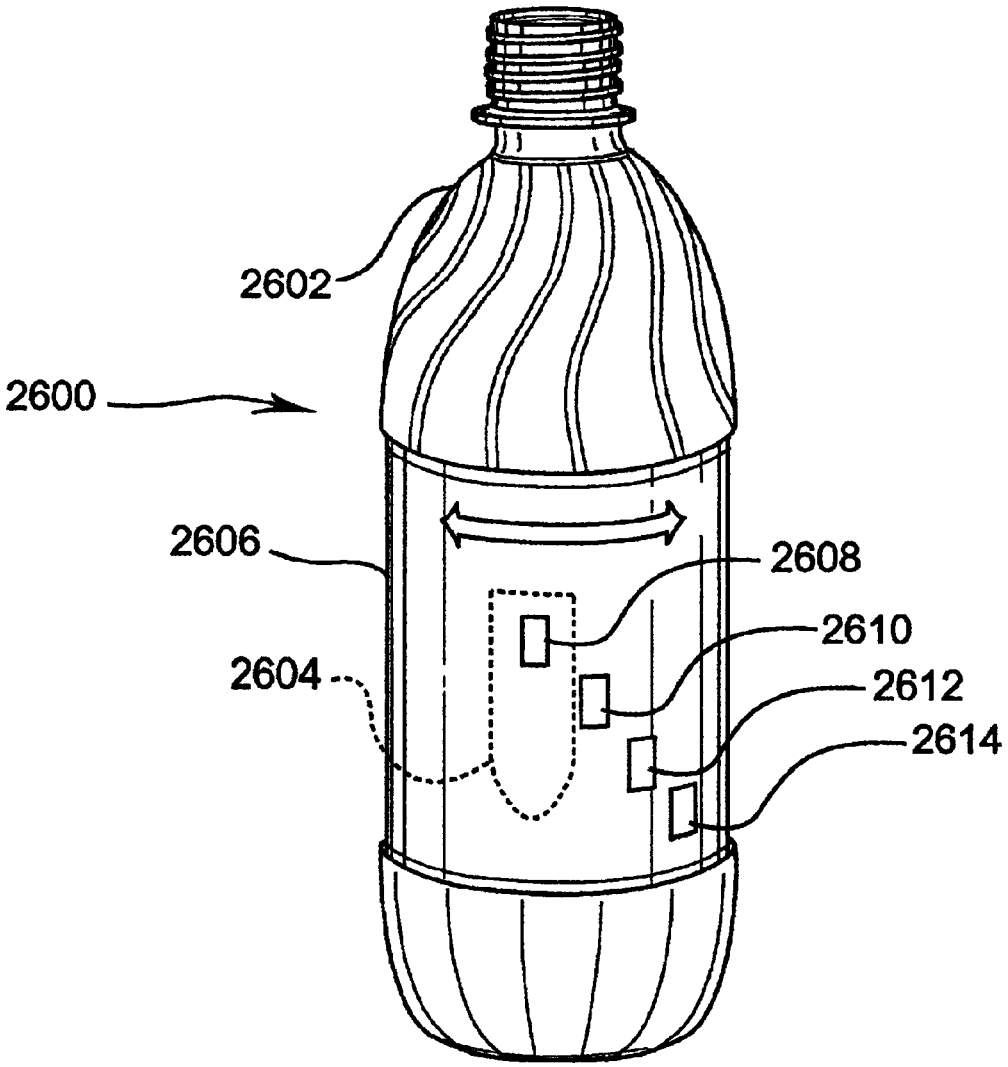
FIG. 26 is a perspective view of an embodiment of the inventive label configuration of the present invention having a first label and a second label wherein the second label is assembled so that it can be twisted about the bottle.

FIG. 26 illustrates a perspective view of embodiment of the inventive label configuration 2600 that comprises a bottle 2602, a first label 2604, and a second label 2606. Several windows 2608, 2610, 2612, and 2614 are in second label 2606.

Figure 27:
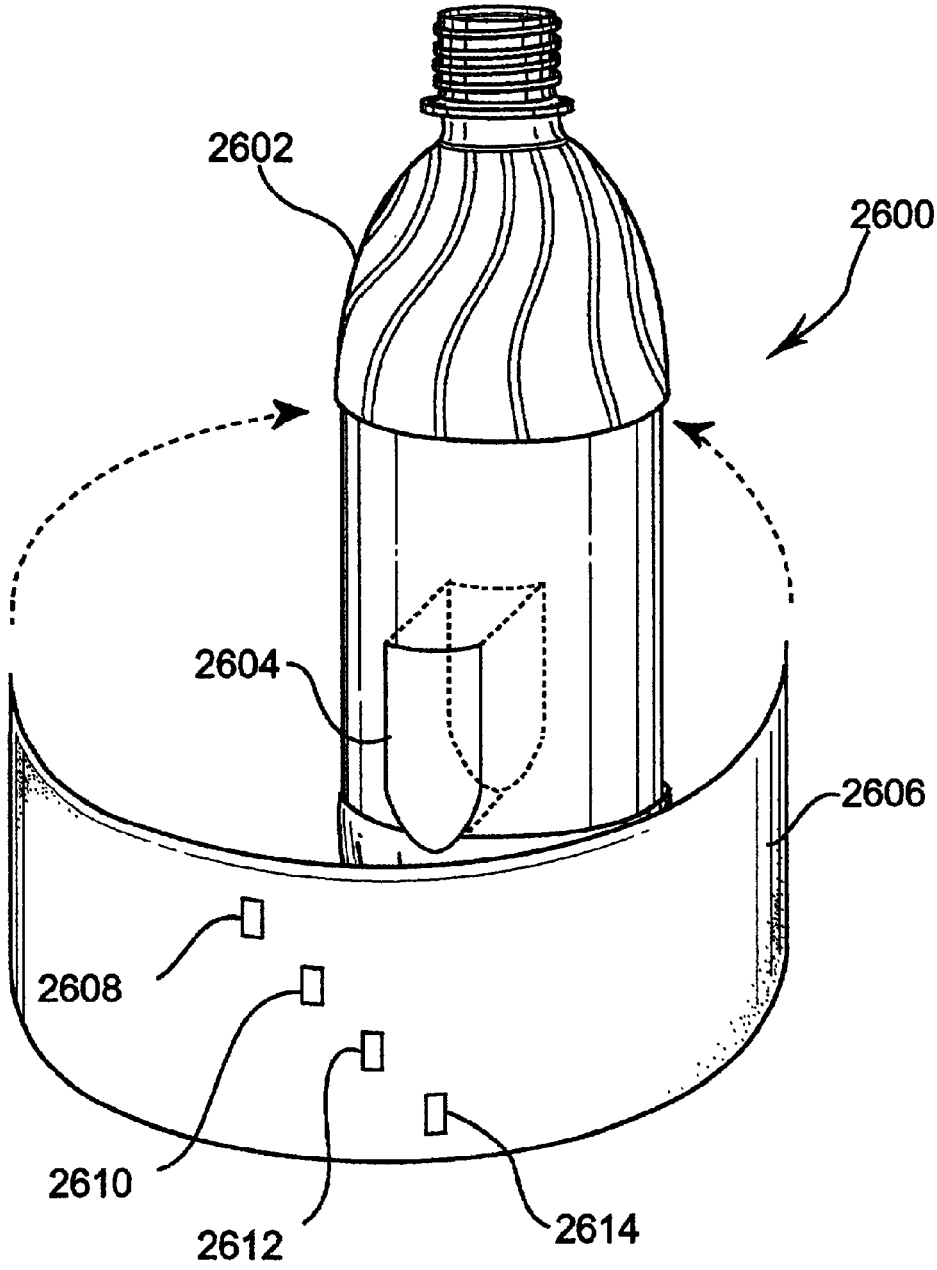
FIG. 27 is a perspective view of FIG. 26 shown in the exploded state.

FIG. 27 illustrates an exploded view of embodiment 2600. First label 2604 is attached to bottle 2602, then second label is attached to bottle 2606. Embodiment 2600 comprises second label 2606 that is attached by gluing only the overlapping portion of second label 2606 to itself. This results in second label 2606 being free to rotate about the bottle 2602. Since the second label 2606 is free to rotate about the bottle, the various windows and the first label 2604 can be combined to form a 'secret decoder' type of promotional game. The play of the secret decoder game is to align the windows of the second label 2606 over portions of first label 2604 so that a certain pattern or winning combination is viewable through the windows.

The number of objects attached to the bottle 2602 in the inventive embodiment 2600 is not limited to two. Any number of items may be attached to bottle 2602 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment with three items could be to place a passive electrical device and a game piece on a bottle, then place an overwrapping label that covers the electrical device, but leaves the game piece exposed through the windows in the overlapping label.

Figure 28:
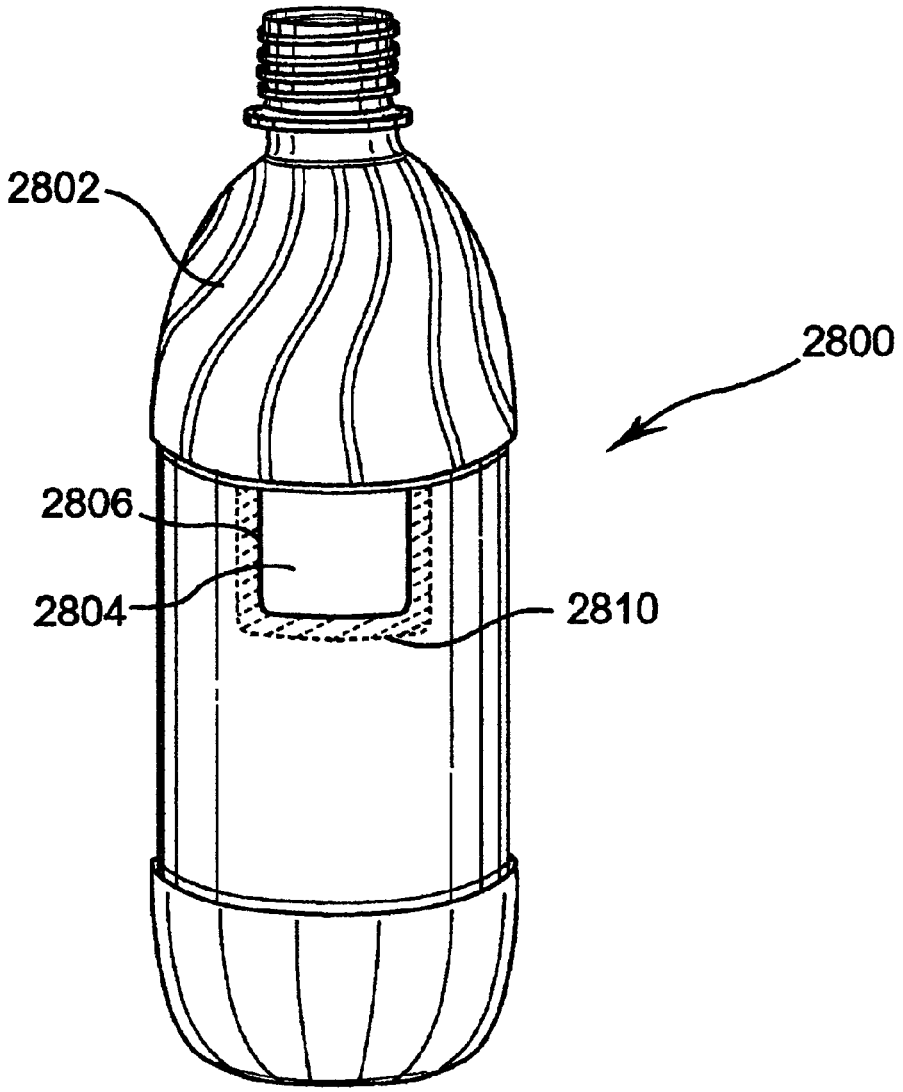
FIG. 28 is a perspective view of an embodiment of the inventive label configuration of the present invention having a first label and a second label wherein the first label is exposed through a window in the second label wherein the window is comprised of a notch in the second label.

FIG. 28 illustrates a perspective view of an embodiment of inventive label configuration 2800, comprising a bottle 2802, a first label 2804, and a second label 2806, wherein first label 2804 is viewable through a cut out 2808 in second label 2806.

Figure 29:
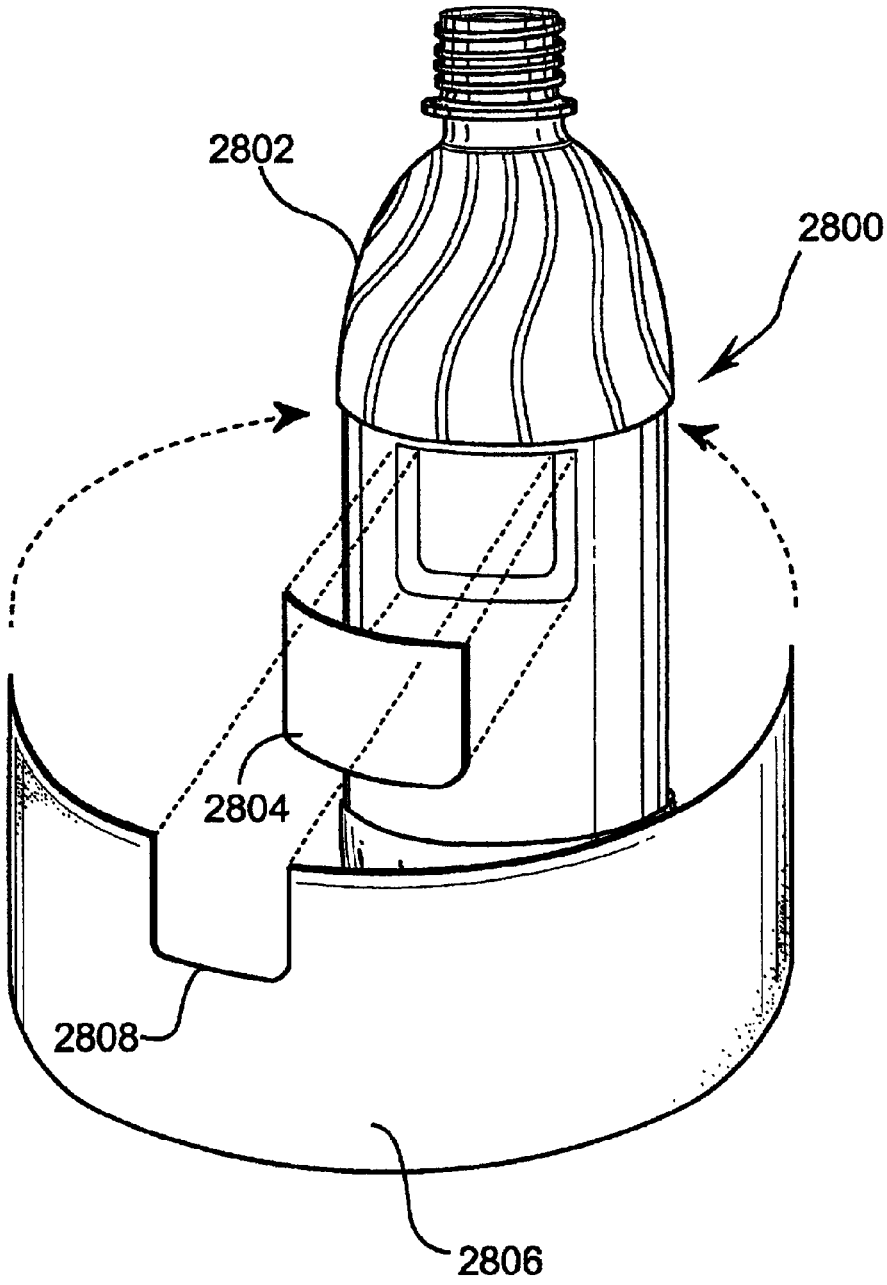
FIG. 29 is a perspective view of FIG. 28 shown in the exploded state.

FIG. 29 illustrates an exploded view of embodiment 2800. First label 2804 is placed on bottle 2802 and then second label 2806 is placed onto bottle 2802 such that at least a portion of first label 2804 is viewable through cutout 2808 in second label 2806. The cutout 2808 is shown as a rectangular cutout. However, the shape of the cutout 2808 can be entirely arbitrary. The window 2808 may be manufactured by several methods. For a label that is manufactured from a material that is clear, such as a clear plastic film, the window area may be manufactured by selectively not printing any ink across the area defined by the window. Another method, which is applicable to label material that is either opaque or clear, is to die cut and remove the label material in the area of the window. In the case where second label 2806 is printed directly on the bottle, the window 2808 may be created by selectively not printing ink in the area of window 2808. The window 2808 may be clear, tinted, or selectively tinted through the manufacturing process of the second label 2806. The size and shape of the window 2808 may be varied widely, including rectangular, circular, or any arbitrary shape.

The embodiment 2800 may comprise a first game piece 2804 that is designed to be removed by the consumer. Perforations, scoring, or other mechanisms may be employed to ease the removal of first game piece 2804. Further, first game piece 2804 may be constructed of a multi-ply construction wherein an outer ply is intended to be removed by the consumer, leaving the bottommost ply on the bottle 2802.

Embodiment 2800 may comprise a first label 2804 that is constructed of a material such as a diffraction grating that is designed as an eye catching device and is incorporated into the graphics of the second label 2806. The shape of cutout 2808 may be a graphical element that is then filled in with the diffraction grating of first label 2804.

The number of objects attached to the bottle 2802 in the inventive embodiment 2800 is not limited to two. Any number of items may be attached to bottle 2802 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment with three items could be to place a diffraction grating and a game piece on a bottle, then place an overwrapping label that covers the game piece, but leaves the diffraction grating exposed through the windows in the overlapping label.

Figure 30:
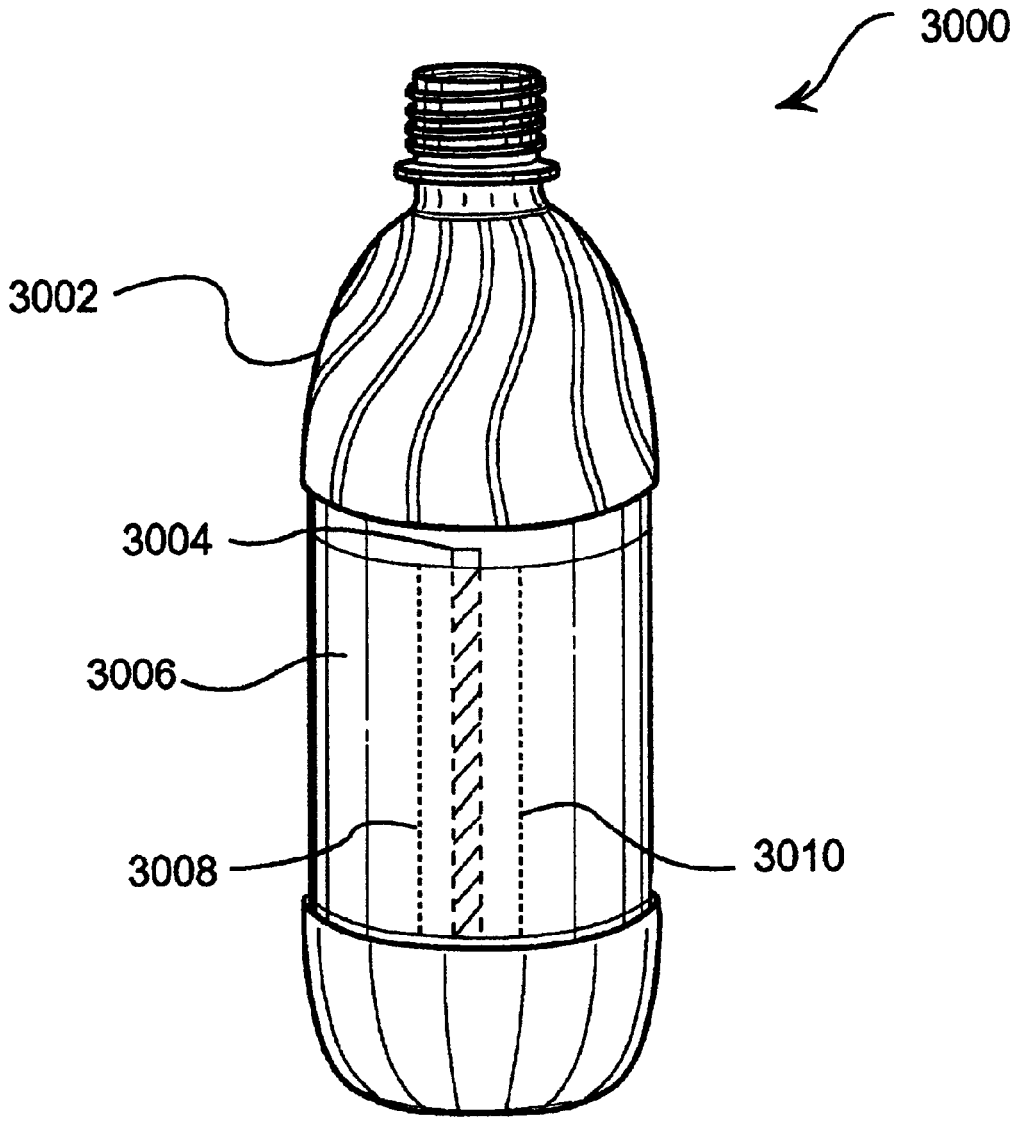
FIG. 30 is a perspective view of an embodiment of the inventive label configuration of the present invention having a label and a device to aid in removing the label.

FIG. 30 illustrates a perspective view of an embodiment of the inventive label configuration 3000 that comprises a bottle 3002, a tear strip 3004, and a label 3006 that comprises optional perforated lines 3008 and 3010.

Figure 31:
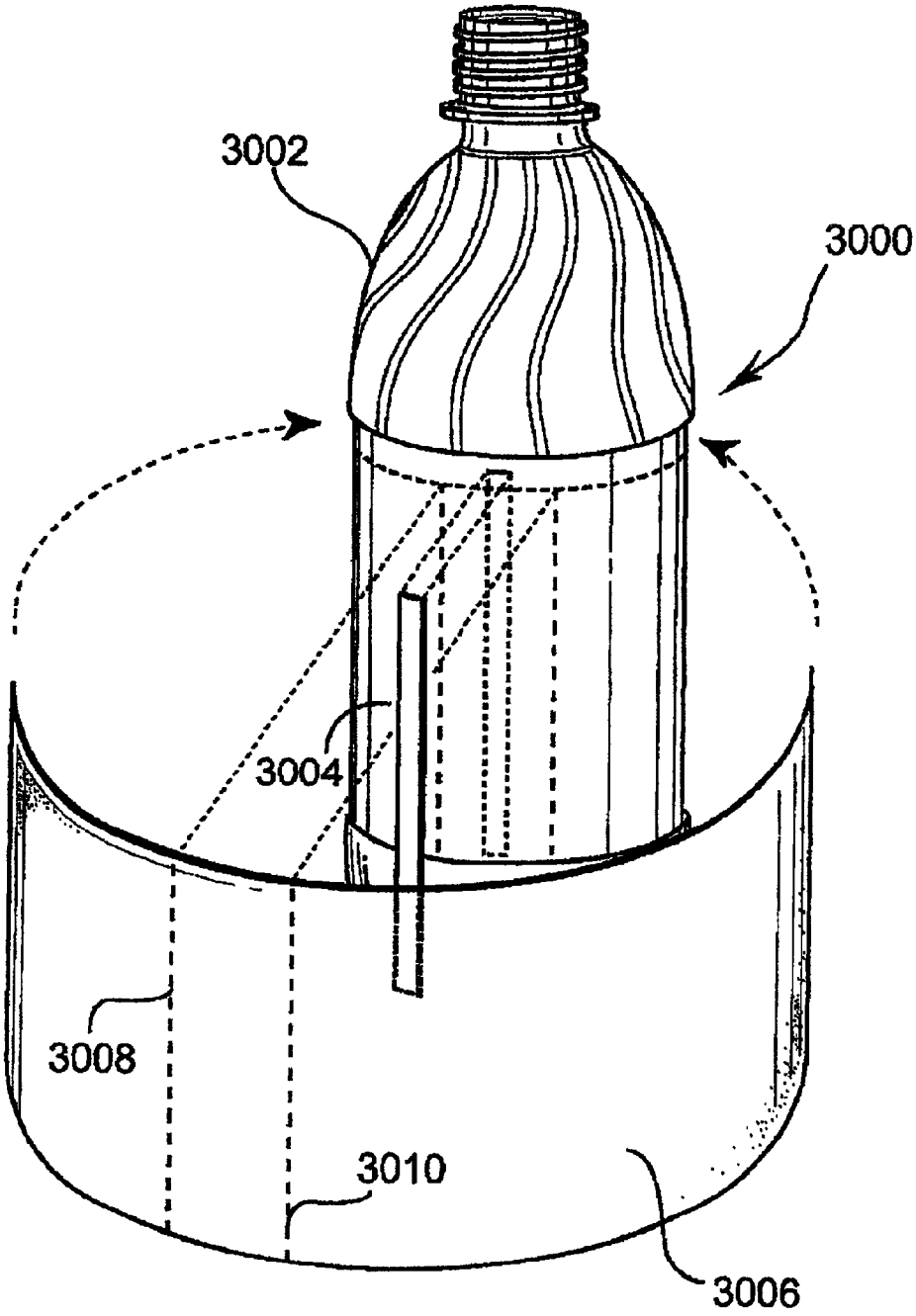
FIG. 31 is a perspective view of FIG. 30 shown in the exploded state.

FIG. 31 illustrates an exploded view of embodiment 3000. The tear strip 3004 is attached to bottle 3002, then label 3006 is attached over the tear strip 3004 to bottle 3002. The embodiment 3000 may be a container for a beverage with a recipe printed on the inside of label 3006. In order for the consumer to retrieve the recipe, the consumer would grasp the exposed portion of tear strip 3004 and pull downward, tearing the label 3006 at one or both perforated lines 3008 and 3010.

Tear strip 3004 may be constructed of a heavy paper or plastic film, or the pull tab 3004 may be constructed of string or wire. The tear strip 3004 may comprise adhesive between the tear strip 3004 and label 3006, or the label 3006 may comprise adhesive in the overlapping area between label 3006 and tear strip 3004. The tear strip 3004 may have an exposed tab or may be hidden behind the label 3006. These examples are not meant to limit the types of labels and of course, those skilled in the arts of promotional items, labels, and the general packaging industry would be able to expand these examples and still fall within the scope of this invention.

Perforated lines 3008 and 3010 may be actual perforations, scoring, or other mechanical weakening of the label 3006 in the areas of lines 3008 and 3010. Alternatively, the label 3006 may be constructed of a material that preferentially tears in the direction of the perforations, eliminating the need for the mechanical perforations or scoring. For applications where the entire label 3006 is to be removed by the consumer, only one perforated line 3008 would be needed. For applications where only a portion of label 3006 is to be removed, two perforated lines would be used.

Embodiment 3000 may be adapted for labels that have coupons reverse printed, meaning printed on the inner side of the label. Further, labels that are designed to cover a specific printed message may be exposed using the tear strip 3004 as part of a promotional campaign.

The number of objects attached to the bottle 3002 in the inventive embodiment 3000 is not limited to two. Any number of items may be attached to bottle 3002 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment with three items could be a game piece attached to a bottle, a tear strip attached to the bottle, and a wrap around label covering both the game piece and the tear strip.

Figure 32:
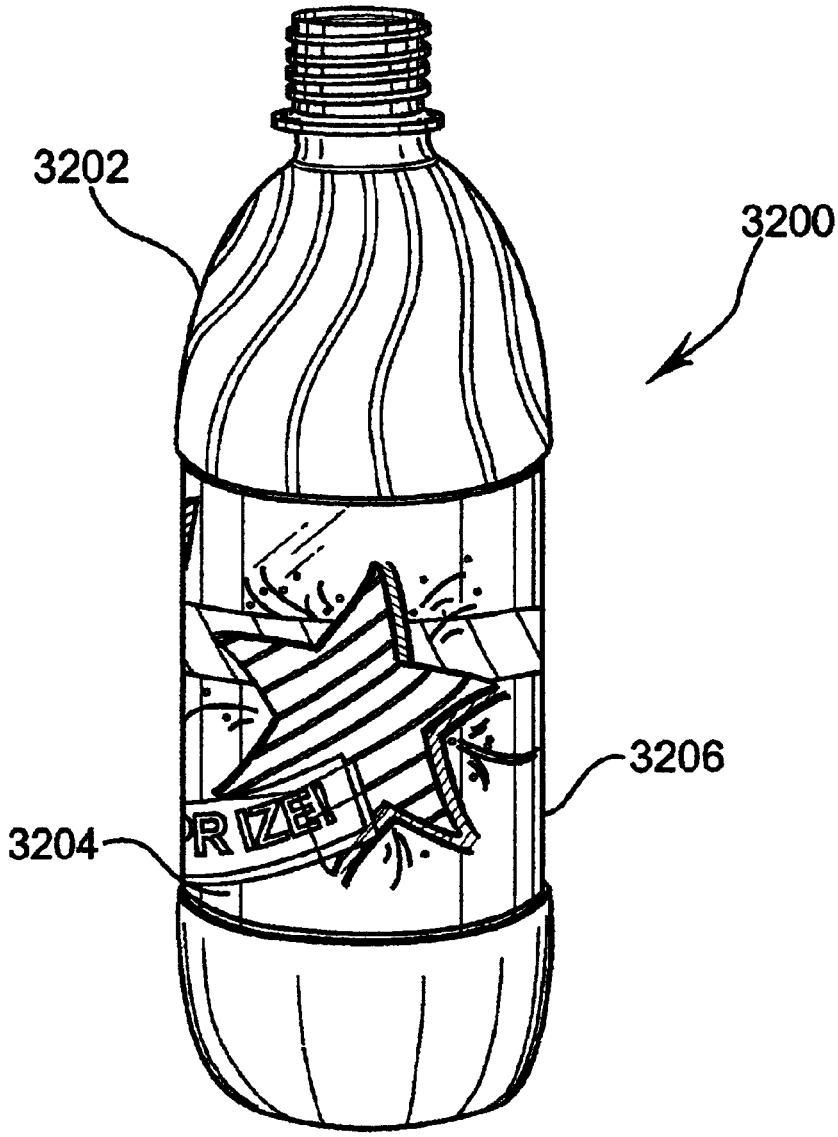
FIG. 32 is a perspective view of an embodiment of the inventive label configuration of the present invention comprising a first label and a second label wherein the second label is a semi-transparent label that covers the first label.

FIG. 32 illustrates a perspective view of an embodiment of the inventive label configuration 3200 of the invention comprising a bottle 3202, a first label 3204, and a second label 3206 where the second label 3206 is constructed of a translucent plastic film.

Figure 33:
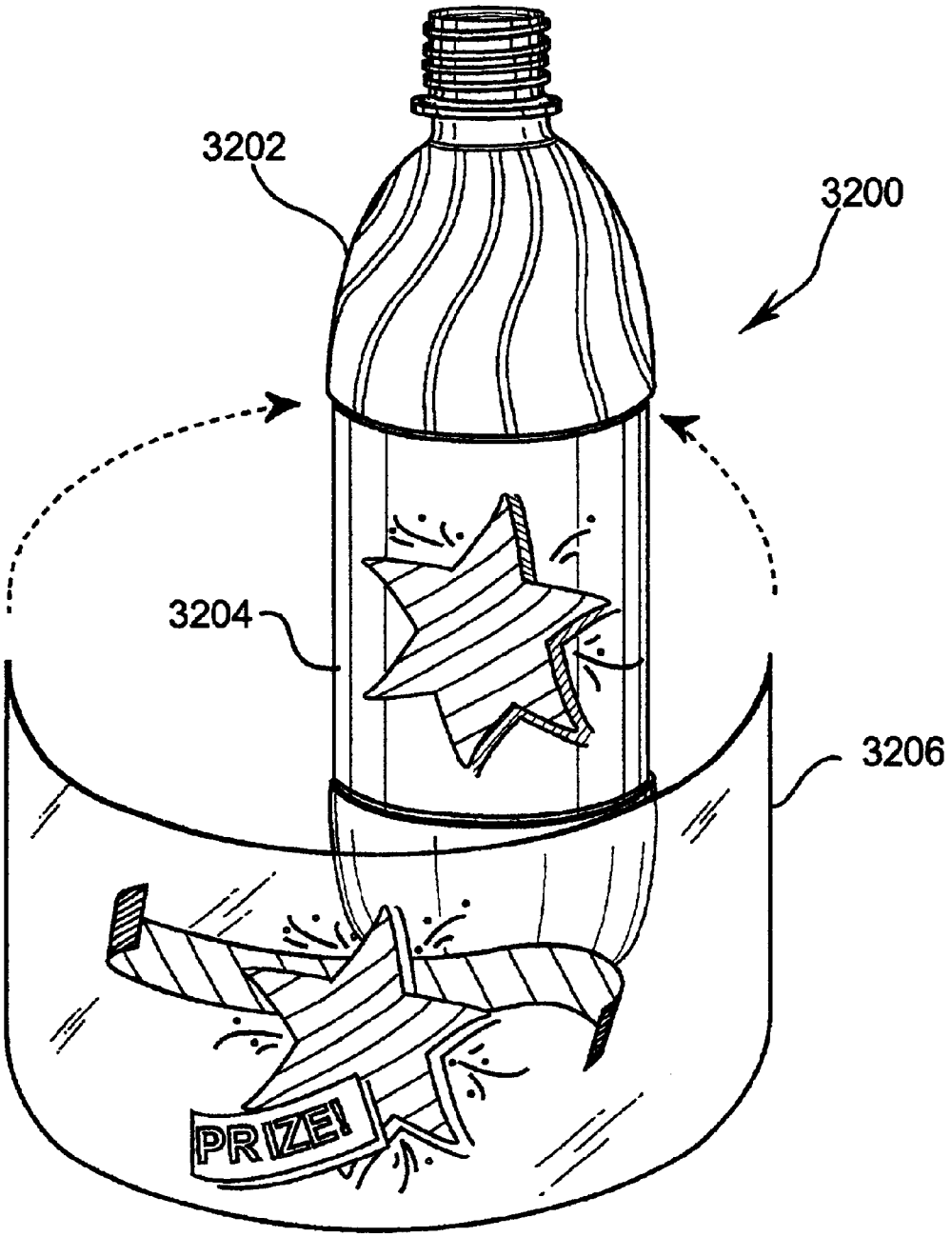
FIG. 33 is a perspective view of FIG. 32 shown in the exploded state.

FIG. 33 illustrates an exploded view of embodiment 3200. The first label 3204 is attached to bottle 3202 and a second label 3206 is attached to bottle 3202 over first label 3204.

Embodiment 3200 is illustrated as a first label 3204 being a standard packaging for the product normally contained in bottle 3202. Second label 3206 is a special promotional label that highlights a promotion for the product. The graphics on the second label 3206 are coordinated with the graphics on the first label 3204 to enhance the eye catching appeal at the same time keeping the standard graphics for the product.

Another embodiment 3200 may comprise a second label 3206 as a game whereby the second label must be removed so that the game may be played. Further, another embodiment 3200 may have a second label 3206 as a second graphical element for a standard package for the product.

Embodiment 3200 may comprise a first label 3204 printed on a material that is not very scratch resistant and a second label 3206 that is considerably more scratch resistant, whereby the second label 3206 provides a scratch resistant cover for the first label 3204. The second label 3206 may comprise some printed graphical elements on either the obverse or reverse side of the label. Obverse printing is printing on the exterior side of the label and reverse printing is on the interior side of the label. Obverse and reverse printing on a plastic film can give interesting and eye-catching three-dimensional effects to the packaging, which are only intensified when coordinated with the graphics printed on the first label 3204.

Another embodiment 3200 may comprise a first label as a holographic image, diffraction grating, reflective media, or other material and the second label is coordinated so that the advertising elements on the first and second labels work with each other.

The number of objects attached to the bottle 3202 in the inventive embodiment 3200 is not limited to two. Any number of items may be attached to bottle 3202 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment with three items could be a first label with a specific graphical element, a second label with a second construction and a second graphical element, and a third label which serves as a protective cover as well as contributing a graphical element, all three graphical elements are adapted to work together for brand identity.

Figure 34:
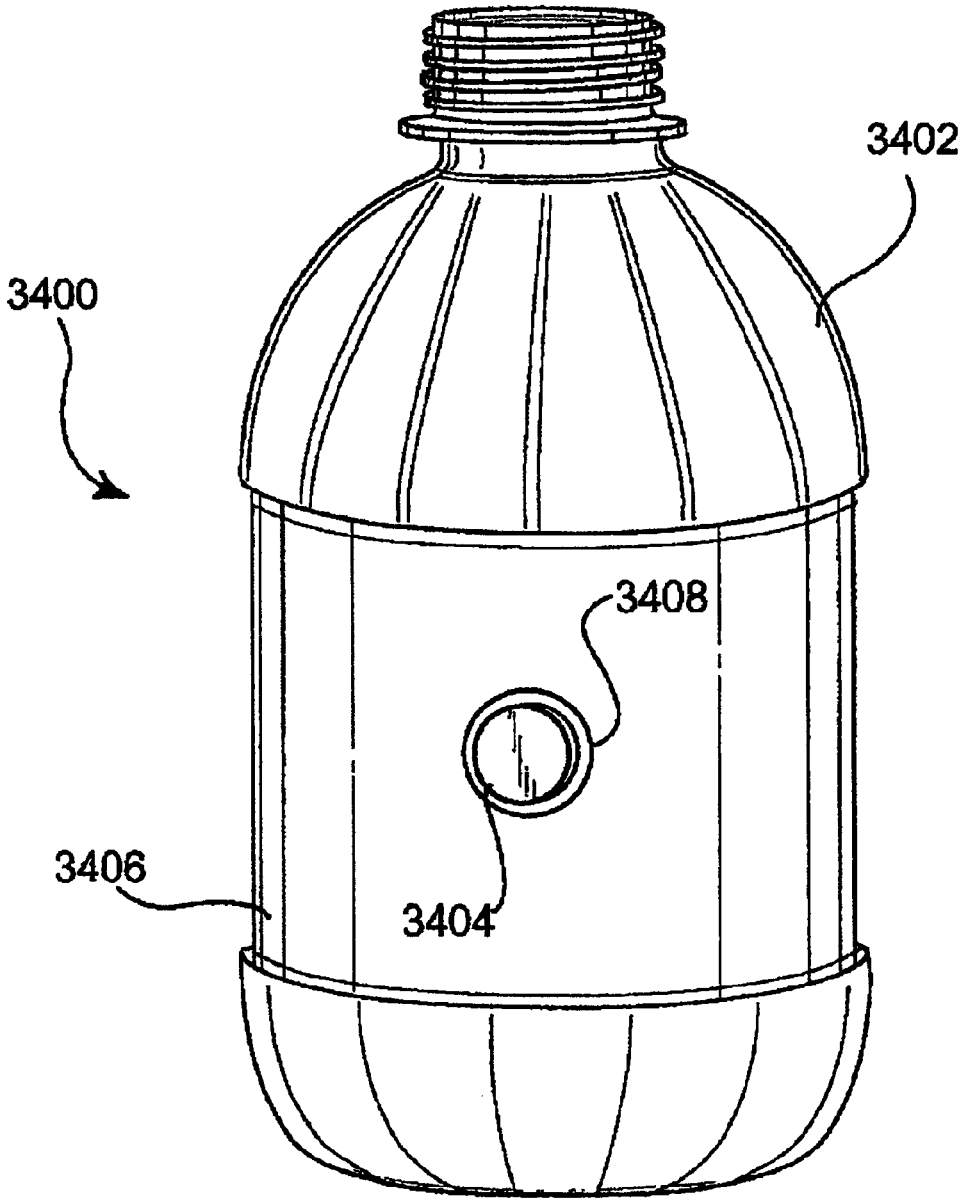
FIG. 34 is a perspective view of an embodiment of the inventive label configuration of the present invention having a first item and a second label wherein the first item protrudes through a window in the second label.

FIG. 34 illustrates a perspective view of an embodiment of the inventive label configuration 3400 of the invention comprising a bottle 3402, a second container 3404, and a label 3406 which comprises a window 3408 through which a portion of container 3404 protrudes.

Figure 35:
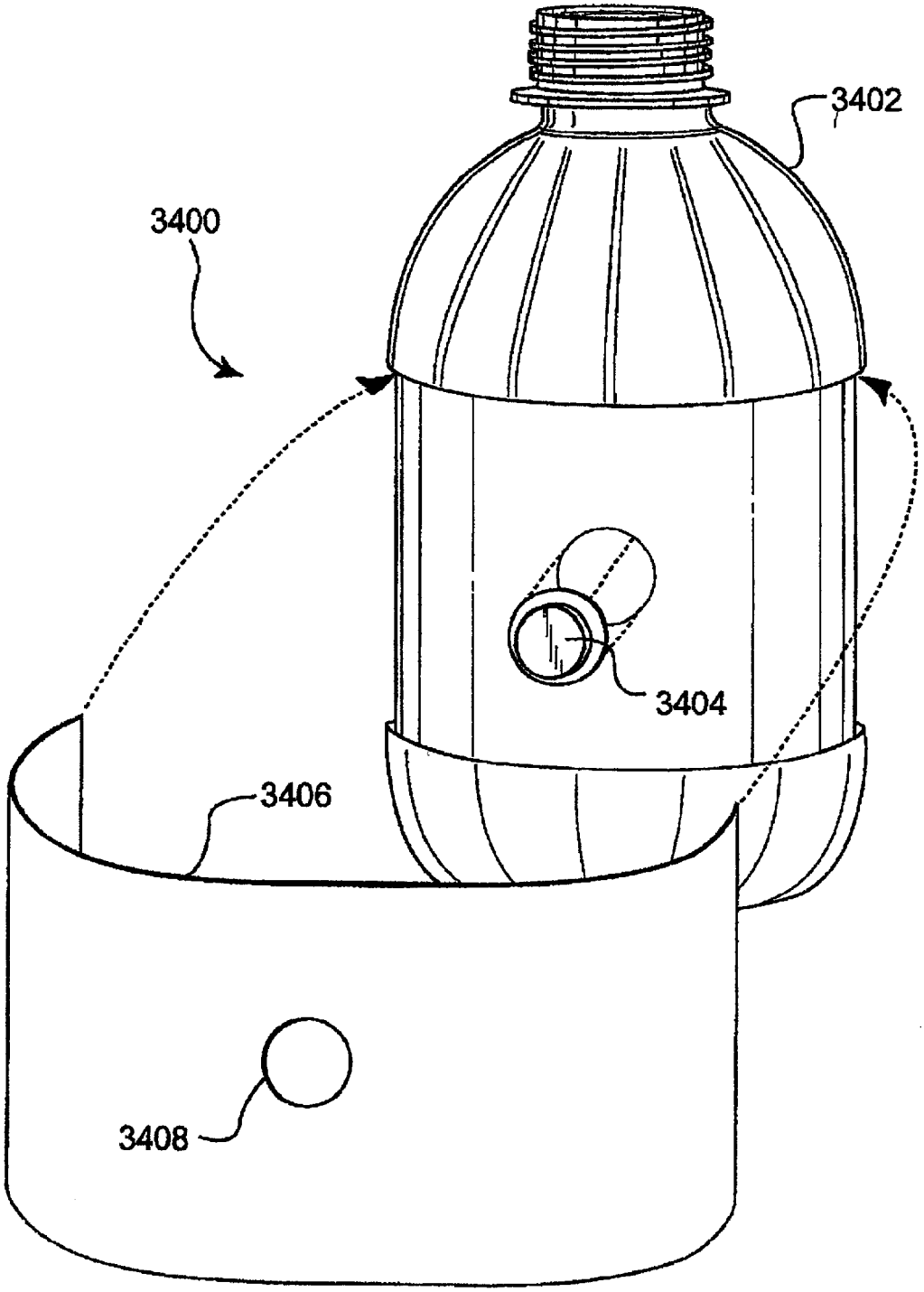
FIG. 35 is a perspective view of FIG. 34 shown in the exploded state.

FIG. 35 illustrates an exploded view of embodiment 3400. Container 3404 is attached to bottle 3402, then label 3406 is placed on the bottle 3404 so that the window 3408 allows all or a portion of container 3404 to protrude through window 3408.

Embodiment 3400 may comprise a container 3404 as an injection molded plastic design used in conjunction with the label 3406 in a purely decorative fashion. In this case, the container 3404 may not contain anything at all, but serve only to add texture to the advertisement on the bottle. In another embodiment, the container 3404 may consist of a piece of soft material that protrudes through the window 3408 to give the product a different tactile sensation to the customer.

The container 3404 may encapsulate or hold a premium, game token, or other promotional item inside the first object 3404. The consumer would therefore be required to open the container 3404 in order to play the game.

In another embodiment 3400, container 3404 may house a second consumable item that goes with the product sold in the bottle 3402. For example, if the product sold in the bottle 3402 was iced tea, the object 3404 may be a small container of lemon juice. Further, if the bottle 3402 contained paint, object 3404 may contain a catalyst adapted to be mixed into the paint prior to application. Another example is for object 3404 to contain a light oil or lubricant when the bottle 3402 is a container of hardware items. Further, the object 3404 may contain fasteners that are used to install a component sold inside a container 3402.

The number of objects attached to the bottle 3402 in the inventive embodiment 3400 is not limited to two. Any number of items may be attached to bottle 3402 which each require registration with respect to each other. The example of two labels is given only for exemplary purposes and it can be fully appreciated by persons skilled in the art that the same principles and concepts of the invention do encompass designs wherein numbers of items greater than two are applied to an object. An embodiment with three items could be a game piece attached to a bottle, a plastic injection molded cover which is placed over the game piece, and an overall label that has the injection molded cover protruding through a window in the overall label.

The present invention therefore provides an inventive machine that has the unique ability to control the movement of a bottle through an in-line machine in a manner that allows registration between the operations. The operations typified in this specification have been the placement of labels and other decorative elements. However, other operations are envisioned as part of the present invention. For example, the dispensing of glue onto an object at one station and the placement of another object onto the glue would require registration between the glue dispensing and the object placement. Further, multiple printing operations may also require registration between printing operations and may therefore be manufactured on the inventive machine. The mechanisms that control the position of the object in the cradle being processed can vary widely from a stationary friction fence to a servo controlled belt system with varying speed profiles.

The inventive label configurations comprise at least two different elements that are registered with respect to each other to create unique and useful devices. The placement of specially printed game pieces on a container with a separate display label can take on several forms, including having the game piece being fully or partially hidden from view by the second label. Further, elements that are printed on the container may be registered with respect to other labels and elements that are subsequently applied.

The inventive packaging configurations comprise the embodiments wherein a first container is applied to a second container and a label is placed or another process performed with respect to the position of the first container. Other embodiments include the case where a label is applied to a first container and a second container is applied to the label, positioned and registered with respect to the label.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of applying at least two labels to a substantially cylindrical object with a predetermined angular orientation of said labels about an axis of said cylinder on an in-line labeling machine comprising:

placing said object into a cradle, said cradle allowing said object to freely rotate about said axis, said cradle being part of a star wheel comprising a plurality of said cradles;

passing said object past a first labeling machine, said first labeling machine being capable of presenting a first label and applying said first label to said object by rotating said object in said cradle;

positioning said object having said first label thereon with a turning mechanism, said turning mechanism having a mechanism that engages said object on the cylindrical surface and changes the rotational orientation of said object to a predetermined orientation in said cradle; and presenting said object having said predetermined orientation to a second labeling machine, said second labeling machine being capable of presenting a second label and applying said second label to said object by initially rotating said object in said cradle, said second label being in a predetermined angular orientation with respect to said first label.

2. The method of claim 1 wherein said turning mechanism comprises a wheel that engages said object, said wheel being capable of moving at a speed proportional to the angular speed of said star wheel.

3. The method of claim 1 wherein said turning mechanism comprises a rigid fence that engages said object and causes said object to rotate a predetermined amount as said star wheel rotates.

4. The method of claim 1 wherein said turning mechanism comprises a belt that engages said object, said belt being capable of moving at a speed proportional to the angular speed of said star wheel.

5. The method of claim 4 wherein the speed of said belt is defined by a speed profile, said speed profile being such that the speed of said belt changes during a period of time that said belt is in contact with said object, said speed profile being proportional to said speed of said angular speed of said star wheel.

6. An in-line machine for applying at least two labels to a substantially cylindrical object with a predetermined angular orientation of said labels about an axis of said cylinder comprising:

a star wheel, said star wheel comprising a plurality of cradles, said cradles allowing said object to freely rotate about said axis;

a first labeling machine, said labeling machine being capable of presenting a first label and applying said first label to said object by rotating said object in said cradle;

a turning mechanism, said turning mechanism having a mechanism that engages said object and changes the rotational orientation of said object to a predetermined orientation in said cradle; and a second labeling machine, said labeling machine being capable of presenting a second label and applying said second label by initially rotating said object in said cradle to said object, said second label being in a predetermined angular orientation with respect to said first label.

7. The machine of claim 6 wherein said turning mechanism comprises a rigid fence that engages said object and causes said object to rotate a predetermined amount as said star wheel rotates.

8. The machine of claim 6 wherein said turning mechanism is incorporated into said first labeling machine.

9. The machine of claim 6 wherein said turning mechanism comprises a belt that engages said object, said belt being capable of moving at a speed proportional to the angular speed of said star wheel.

10. The machine of claim 9 wherein the motion of said belt is defined by a motion profile, said motion profile being such that the speed of said belt changes during the period of time that said belt is in contact with said object, said motion profile being coupled to the motion of said star wheel.

11. The machine of claim 6 wherein said turning mechanism comprises a wheel that engages said object, said wheel being capable of moving at a speed proportional to the angular speed of said star wheel.

12. The machine of claim 11 wherein said turning mechanism is incorporated into said first labeling machine.

* * * * *